US007429041B2

(12) United States Patent
Yokoi

(10) Patent No.: US 7,429,041 B2
(45) Date of Patent: Sep. 30, 2008

(54) APPARATUS FOR FEEDING SHEET USING RETRACTABLE EDGE GUIDE FOR GUIDING LATERAL EDGE OF SHEET

(75) Inventor: Katsuyuki Yokoi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 488 days.

(21) Appl. No.: 11/033,152

(22) Filed: Jan. 12, 2005

(65) Prior Publication Data

US 2005/0151315 A1 Jul. 14, 2005

(30) Foreign Application Priority Data

Jan. 14, 2004 (JP) ..... 2004-006333

(51) Int. Cl.
*B65H 1/00* (2006.01)

(52) U.S. Cl. ..... 271/162; 271/9.09; 271/145; 271/171; 399/392

(58) Field of Classification Search ..... 271/9.09, 271/162, 171, 164, 223–224, 145; 399/125, 399/392, 393; 211/50, 126.5–126.7; 347/104
See application file for complete search history.

(56) References Cited

U.S. PATENT DOCUMENTS 6,000,692 A * 12/1999 Lee ..... 271/248
6,916,020 B2 * 7/2005 Hasegawa ..... 271/171
7,036,813 B2 * 5/2006 Asada ..... 271/117
2003/0151188 A1 * 8/2003 Imahara ..... 271/171
2003/0178764 A1 9/2003 Hasegawa
2006/0082044 A1 * 4/2006 Aida ..... 271/145
2007/0001382 A1 * 1/2007 Matsumoto et al. ..... 271/162
2007/0222136 A1 * 9/2007 Murakami ..... 271/9.09

FOREIGN PATENT DOCUMENTS

JP 02100927 A * 4/1990
JP 06-286888 10/1994
JP 06-345274 12/1994
JP 10-291696 11/1998
JP 2000-72265 3/2000
JP A-2003-267561 9/2003

* cited by examiner

*Primary Examiner*—Patrick Mackey
*Assistant Examiner*—Jeremy Severson
(74) *Attorney, Agent, or Firm*—Oliff & Berridge, PLC

(57) ABSTRACT

An apparatus for feeding a sheet to a processing device processing the sheet is disclosed that includes: a feeder tray displaceable to a selected one of a retracted position and an unfolded position relative to the processing device, and having a sheet-loaded plane on which the sheet to be fed is to be loaded; a pair of edge guides disposed at the sheet-loaded plane, having a pair of corresponding respective side walls co-extending along a feeding direction of the sheet in opposed relation with each other, to thereby guide lateral edges of the sheet; and a supporting device supporting each of the edge guides pivotably about a pivot axis perpendicular to the feeding direction, to thereby allow the each edge guide to be displaced to a selected one of a standing position on the sheet-loaded plane and an inclined position inclined to the standing position,

34 Claims, 23 Drawing Sheets

APPARATUS FOR FEEDING SHEET USING RETRACTABLE EDGE GUIDE FOR GUIDING LATERAL EDGE OF SHEET

This application is based on Japanese Patent Application No. 2004-006333 filed Jan. 14, 2004, the content of which is incorporated hereinto by reference.

CROSS-REFERENCE TO RELATED APPLICATIONS

Not Applicable.

BACKGROUND OF THE INVENTION

1. Field of the Invention

The present invention relates to an apparatus for feeding a sheet using edge guides for guiding the lateral edges of the sheet, and more particularly to a technique of reducing a space required for accommodating the apparatus for feeding a sheet.

2. Description of the Related Art

An apparatus for feeding a sheet (hereinafter, referred to as "sheet feeder") is for use in various applications. One of the applications is an apparatus for forming an image (hereinafter, referred to as "image forming apparatus") such as a printer. Such a sheet feeder for use in combination with such an image forming apparatus is categorized into one for use in manual feed, and one for use in auto feed. The auto feed allows stacked sheets to be separated, to thereby feed individual sheets one by one.

Such a sheet feeder allows a feeding of a sheet using edge guides guiding the lateral edges of the sheet to be fed.

More particularly, as disclosed in Japanese Patent Publication No, Hei 10-291696, for example, such a sheet feeder is configured to include: a feeder tray displaceable to a selected one of a retracted position and an unfolded position relative to an image forming apparatus, and having a sheet-loaded plane on which the sheet to be fed to the image forming apparatus is to be loaded; and a pair of edge guides disposed at the sheet-loaded plane, having a pair of corresponding respective side walls co-extending along a feeding direction of the sheet in opposed relation with each other, to thereby guide lateral edges of the sheet.

An example of such a sheet feeder is further configured such that the edge guides are movable relative to each other in a direction perpendicular to the feeding direction of the sheet, to thereby control the width of a sheet travel path on the sheet-loaded plane.

For accommodating such a sheet feeder, an example of the image forming apparatus is configured to have an exposed recess formed in a body panel of the image forming apparatus at a position in conformity with a space in which the edge guides are to be displaced.

In this example, once the feeder tray is brought into the retracted position relative to the image forming apparatus, the edge guides are retracted or accommodated within the recess. For the reason, the image forming apparatus is required to be configured such that the recess is dimensioned to avoid the edge guides from abutting the body panel of the image forming apparatus, irrespective of where the edge guides are positioned.

BRIEF SUMMARY OF THE INVENTION

A conventional sheet feeder is configured such that the edge guides disposed at the feeder tray are always each placed in the standing position on the sheet-loaded plane, resulting in a fixed size in height of the edge guides. The recess is required to be deep enough to accommodate the height of the edge guides so as not to cause physical interference between the recess and the edge guides upon the feeder tray being retracted. As a result, the conventional sheet feeder makes it more difficult to downsize the image forming apparatus.

Further, the downsizing of the image forming apparatus without reduction in depth of the recess for storage of the edge guides would affect the interior of the image forming apparatus. In general, the image forming apparatus contains a laser scanner device, a toner delivery device, a developing device, a cleaning device, a fusing device, etc.

An example of the image forming apparatus is configured such that the cleaning device and the fusing device are disposed adjacent to each other. In this example, the reduction in clearance between the cleaning device and the fusing device would possibly arise a heat problem in the cleaning device due to heat in the fusing device, possibly resulting in melting of toner accumulated by the cleaning device for cleaning.

In addition, it is understood that the downsizing of a toner box or toner container would contribute to the downsizing of the image forming apparatus with adequate clearances between the adjacent ones of those devices contained in the image forming apparatus being ensured. However, the downsizing of the toner box would require an unfavorable reduction in capacity of the toner box.

It is therefore an object of the present invention to provide an apparatus for feeding a sheet enabling reduction in space required for accommodating the edge guides.

According to the present invention, an apparatus for feeding a sheet is provided in which the edge guides are configured to be retractable or tiltable, resulting in an easier reduction in space required for accommodating the edge guides.

More specifically, according to the present invention, there is provided an apparatus for feeding a sheet to a processing device processing the sheet, comprising:

a feeder tray displaceable to a selected one of a retracted position and an unfolded position relative to the processing device, and having a sheet-loaded plane on which the sheet to be fed to the processing device is to be loaded;

a pair of edge guides disposed at the sheet-loaded plane, having a pair of corresponding respective side walls co-extending along a feeding direction of the sheet in opposed relation with each other, to thereby guide lateral edges of the sheet; and a supporting device supporting each of the edge guides pivotably about a pivot axis perpendicular to the feeding direction, to thereby allow the each edge guide to be displaced to a selected one of a standing position on the sheet-loaded plane and an inclined position inclined to the standing position.

The above apparatus according to the present invention may be practiced such that, once the feeder tray is displaced away from the processing device such as a printer into the unfolded position, the edge guides are brought into the standing position allowing a sheet to be guided, and on the other hand, once the feeder tray is displaced toward the processing device into the retracted position, the edge guides are pivoted to the inclined position allowing the edge guides to be accommodated within the processing device.

The above apparatus according to the present invention is configured to guide a sheet using the retractable or tiltable edge guides facilitating reduction in space required for accommodating the edge guides.

Therefore, where the above apparatus according to the present invention is practiced in combination with the processing device in the form of the aforementioned image forming apparatus, the retractable or tiltable edge guides allow an easier reduction in depth of the recess formed in the image forming apparatus for accommodating the edge guides, contributing to an easier downsizing of the image forming apparatus.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities show. In the drawings.

DETAILED DESCRIPTION OF THE INVENTION

Figure 1:
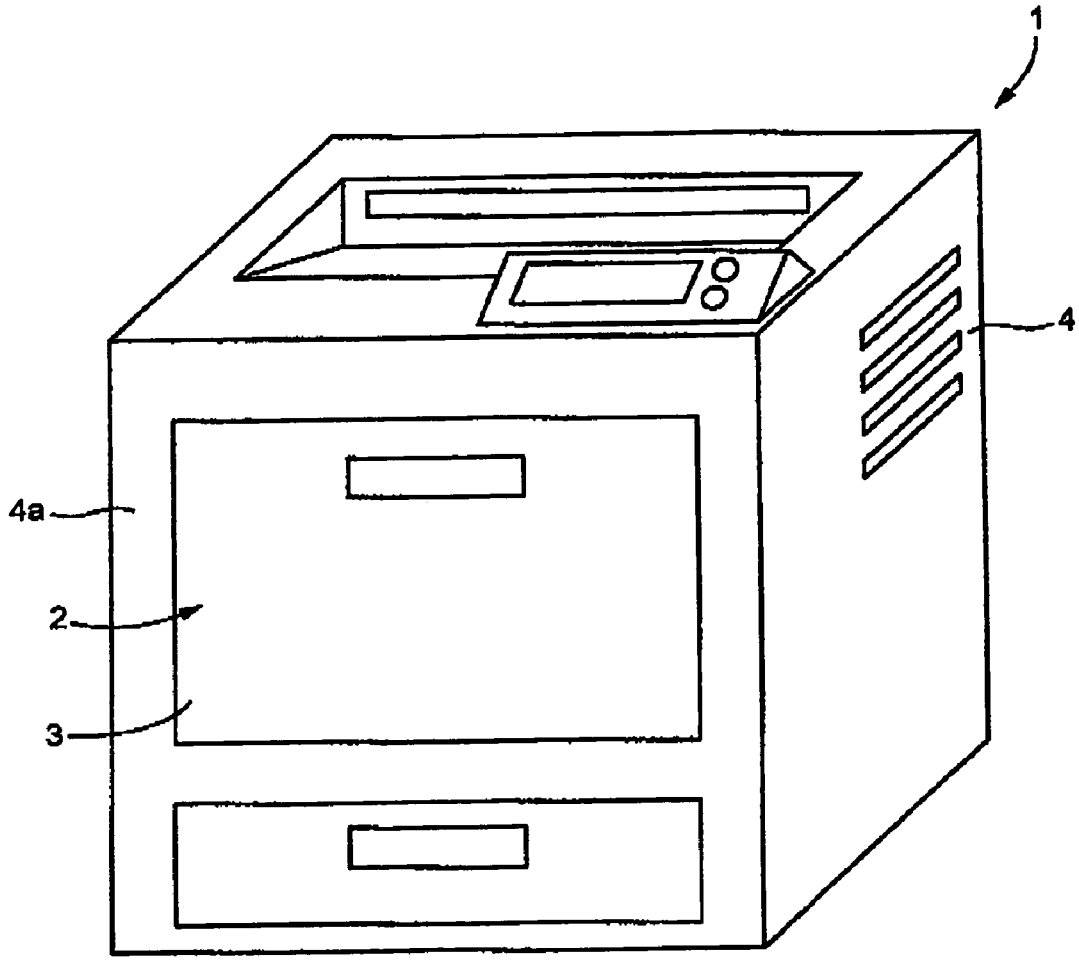
FIG. 1 is a perspective view illustrating the exterior of a laser printer incorporating a sheet feeding unit, with a feeder tray of the sheet feeding unit being in a retracted position, the sheet feeding unit being constructed according to a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) An apparatus for feeding a sheet to a processing device processing the sheet, comprising:

a feeder tray displaceable to a selected one of a retracted position and an unfolded position relative to the processing device, and having a sheet-loaded plane on which the sheet to be fed to the processing device is to be loaded;

a pair of edge guides disposed at the sheet-loaded plane, having a pair of corresponding respective side walls co-extending along a feeding direction of the sheet in opposed relation with each other, to thereby guide lateral edges of the sheet; and a supporting device supporting each of the edge guides pivotably about a pivot axis parallel to the feeding direction, to thereby allow the each edge guide to be displaced to a selected one of a standing position on the sheet-loaded plane and an inclined position inclined to the standing position.

The apparatus according to the above mode (1) may be practiced in a manner that, once the feeder tray is displaced away from the processing device into the unfolded position, the edge guides are brought into the standing position allowing a sheet to be guided, and on the other hand, once the feeder tray is displaced toward the processing device into the retracted position, the edge guides are pivoted to the inclined position allowing the edge guides to be accommodated within the processing device.

The apparatus according to the above mode (1), because of the edge guides being retractable or tiltable, allows an easier reduction in space required for accommodating the edge guides.

The "sheet" set forth in the above mode (1) may be interpreted to mean a sheet of paper, or may be interpreted to mean a sheet of medium made up of any one of materials other than paper, e.g., plastic film.

(2) The apparatus according to mode (1), further comprising a holding mechanism holding each of the edge guides in the standing position, with the feeder tray being in the unfolded position.

(3) The apparatus according to mode (2), wherein the holding mechanism holds each of the edge guides in the standing position, using a friction applied to the each edge guide, with the feeder tray being in the unfolded position.

(4) The apparatus according to mode (2), wherein the holding mechanism elastically biases each of the edge guides toward the standing position, to thereby allow the each edge guide to return to the standing position in timed relation with displacement of the feeder tray from the retracted position to the unfolded position.

(5) The apparatus according to any one of modes (1) through (4), further comprising a tilting mechanism tilting each of the edge guides from the standing position to the inclined position through pivotal movement of the each edge guide in timed relation with displacement of the feeder tray from the unfolded position to the retracted position.

(6) The apparatus according to mode (5), wherein the tilting mechanism tilts each of the edge guides from the standing position to the inclined position through the pivotal movement, using a reaction force applied from the processing device to the each edge guide upon abutting of the each edge guide against the processing device, in timed relation with displacement of the feeder tray from the unfolded position to the retracted position.

(7) The apparatus according to any one of modes (1) through (6), further comprising a moving body disposed at the feeder tray for connecting each of the edge guides to the feeder tray, the moving body being movable in a direction perpendicular to the feeding direction relative to the feeder tray, the each edge guide and the corresponding moving body being formed separately from and rotatably connected with each other at a position located above the sheet-loaded plane.

The apparatus according to the above mode (7) employs a configuration that the edge guides and the corresponding respective moving bodies are formed separately from and rotatably connected with each other at a position located above the sheet-loaded plane. The configuration permits each of the edge guides to be tilted into the inclined position.

Therefore, the apparatus according to the above mode (7) facilitates reduction in space required for accommodating the edge guides, contributing to an easier downsizing of the processing device. For the aforementioned image forming apparatus such as a printer, the above space corresponds to a space within the recess for storage of the edge guides.

(8) The apparatus according to any one of modes (1) through (7), wherein the supporting device is located in the vicinity of the sheet-loaded plane.

The apparatus according to the above mode (8) employs an arrangement allowing each of the edge guides to be pivoted and tilted about the pivot axis located in the vicinity of the sheet-loaded plane. The arrangement allows a much easier reduction in space required for accommodating the edge guides, leading to a much easier downsizing of the processing device.

(9) The apparatus according to any one of modes (1) through (8), wherein the supporting device includes: a shaft disposed at a selected one of each of the edge guides and the corresponding moving body, and extending parallel to the feeding direction; and a bearing device disposed at a remainder of the each edge guide and the corresponding moving body, and supporting the shaft rotatably The apparatus according to the above mode (9) employs an arrangement that the supporting device is constructed using a combination of the shaft and the bearing device. The arrangement allows a smoother pivot of the edge guides.

(10) The apparatus according to mode (9), wherein the bearing device includes a pair of bearings, the shaft includes a pair of ends projecting from both end faces of each of the edge guides opposed to each other in the feeding direction, the shaft is rotatably supported at the pair of projecting ends thereof by the pair of bearings.

The apparatus according to the above mode (10) employs an arrangement that the pair of bearings is engaged with the shaft on both sides of a corresponding one of the edge guides. The arrangement facilitates the assembly of the bearings and the shaft.

(11) The apparatus according to any one of modes (1) though (10), further comprising a holder holding each of the edge guides in a selected one of the standing position and the inclined position, wherein each of the edge guides is positioned in the standing position with the feeder tray being in the unfolded position, while each of the edge guides is pivoted to the inclined position upon displacement of the feeder tray to the retracted position.

(12) The apparatus according to mode (11), wherein the holder includes a pivotal-direction limiter limiting an allowed pivotal direction of each of the edge guides to a predetermined unilateral direction from the standing position.

The apparatus according to the above mode (12) employs the pivotal-direction limiter for surely achieving a unilateral tilt or pivot of each of the edge guides toward the inclined position.

(13) The apparatus according to mode (12), wherein the pivotal-direction limiter is disposed at a corresponding one of the edge guides.

The apparatus according to the above mode (13) allows an easier improvement in position of the pivotal-direction limiter in a corresponding one of the edge guides.

(14) The apparatus according to mode (13), wherein the pivotal-direction limiter includes a bend to a corresponding one of the edge guides, disposed at a base end of the corresponding edge guide, and extending away from a corresponding one of the side walls.

The apparatus according to the above mode (14) allows an easier improvement in shape of the pivotal-direction limiter in a corresponding one of the edge guides.

(15) The apparatus according to any one of modes (1) through (14), wherein each of the edge guide is pivoted between the standing position and the inclined position in timed relation with motion of the feeder tray between the retracted position and the unfolded position.

The apparatus according to the above mode (15) allows pivot of the edge guides without requiring an additional manual action for pivoting the edge guides, rendering the edge guides labor-saving.

(16) The apparatus according to mode (15), wherein each of the edge guides is pivoted to the inclined position upon abutting of the each edge guide against the processing device during displacement of the feeder tray from the unfolded position to the retracted position.

The apparatus according to the above mode (16), upon the feeder tray being brought into the retracted position, allows the edge guides to be pivoted into the inclined position as a result of abutting of the edge guides against the abutting surface of the processing device. An additional manual action is not required for the edge guides to pivot, rendering the edge guides labor-saving.

(17) The apparatus according to mode (16), further comprising a translating mechanism translating a reaction force applied to each of the edge guides from the processing device upon abutting of the each edge guide against the processing device, into a moment causing the each edge guide to be pivoted.

The apparatus according to the above mode (17), because of the translating mechanism, allows the edge guides to be pivoted at improved mechanical efficiency.

(18) The apparatus according to mode (16) or (17), wherein the processing device includes an abutting surface which each of the edge guides abuts during displacement of the feeder tray from the unfolded position to the retracted position, the abutting surface having a profile allowing an application to the each edge guide a force causing the each edge guide to pivot, through abutting of the each edge guide against the abutting surface.

The apparatus according to the above mode (18) employs the abutting surface having a profile allowing an application to each of the edge guides a force causing the each edge guide to pivot. An example of the abutting surface is formed as an inclined surface to the direction in which the edge guides abut the abutting surface.

Therefore, the apparatus according to the above mode (18) allows a much smoother pivot of the edge guides.

(19) The apparatus according to any one of modes (16) through (18), further comprising a friction reduction mechanism reducing a friction developed between each of the edge guides and the processing device, with the each edge guide and the processing device being in contact with each other.

The apparatus according to the above mode (19), because of the friction reduction mechanism conducive to reduction in an unfavorable friction in pivoting the edge guides, provides a smoother pivot of the edge guides.

(20) The apparatus according to mode (19), wherein the friction reduction mechanism includes a roller attached rotatably to a portion of each of the edge guides which is to be brought into contact with the processing device.

The apparatus according to the above mode (20), because of the roller conducive to a more efficient reduction in an unfavorable friction in pivoting the edge guides, provides a much smoother pivot of the edge guides.

(21) The apparatus according to any one of modes (1) through (20), further comprising a biasing mechanism biasing each of the edge guides toward the standing position.

The apparatus according to the above mode (21), because of the biasing mechanism, allows an automated return of the edge guides to the standing position.

(22) The apparatus according to mode (21), wherein the biasing mechanism includes a spring member.

The apparatus according to the above mode (22) makes it easier to stabilize the magnitude of a biasing force applied from the biasing mechanism to the edge guides.

(23) The apparatus according to any one of modes (1) through (14), (21) and (22), wherein each of the edge guides is pivoted between the standing position and the inclined position depending on a manual operation independent of a motion of the feeder tray-between the retracted position and the unfolded position.

The apparatus according to the above mode (23) is advantageous in satisfying the need to separate a motion of the feeder tray from a motion of the edge guides.

(24) The apparatus according to mode (23), further comprising an auxiliary tray slidable parallel to the feeding direction relative to the feeder tray, and displaceable to a selected one of a retracted position and an extended position, each of the edge guides being pivoted from the inclined position to the standing position in timed relation with a manual sliding motion of the auxiliary tray from the retracted position to the extended position relative to the feeder tray.

The apparatus according to the above mode (24) is operated in a manner that each of the edge guides is pivoted from the inclined position to the standing position in timed relation with the manual motion of the auxiliary tray from the retracted position to the extended position. Therefore, the apparatus allows an automated return of the edge guides to the standing position using the manual motion of the auxiliary tray.

(25) The apparatus according to mode (24), further comprising a biasing mechanism biasing each of the edge guides toward the standing position, wherein each of the edge guides includes a base end at which an engaging projection is formed at a position away from the pivot axis, wherein the engaging projection is disposed to be engageable with the auxiliary tray in the retracted position through a hole formed at the sheet-loaded plane, and wherein the engaging projection is moved away from the auxiliary tray upon a sliding motion of the auxiliary tray from the retracted position to the extended position, to thereby allow each of the edge guides to pivot to the standing position by a biasing force provided by the biasing mechanism, while the engaging projection is brought into engagement with the auxiliary tray upon a sliding motion of the auxiliary tray of the extended position to the retracted position, to thereby hold the each edge guide in the inclined position.

The apparatus according to the above mode (25) employs a selective engagement of the engaging projection with the auxiliary tray for ensuring in holding the edge guides in the inclined position.

(26) The apparatus according to any one of modes (1) through (25), wherein the edge guides are independent of each other in pivoting between the standing position and the inclined position.

The apparatus according to the above mode (26) allows both of the edge guides to be pivoted without requiring a linking mechanism linking the edge guides with each other. Therefore, the apparatus makes it easier to avoid the apparatus from becoming more complex in construction, and to reduce a space required for accommodating the edge guides when the feeder tray is in the retracted position with respect to the processing device.

(27) The apparatus according to any one of modes (1) through (26), further comprising a separation feeding mechanism separating sheets stacked on the sheet-loaded plane of the feeder tray, to thereby feed individual sheets one by one.

A type of a sheet feeder using edge guides exists that incorporates a separation feeding mechanism feeding mechanism separating stacked sheets, to thereby feed individual sheets one by one. This type of sheet feeder can be referred to as "multi-purpose tray device." For this type of sheet feeder, the side walls of the edge guides are larger in height because of the need for accommodating the stacked sheets, than a manual feed type of sheet feeder.

In view of the above, the apparatus according to the above mode (27) is configured to include the separation feeding mechanism, and therefore, the apparatus is more advantageous in reducing a space required for accommodating the edge guides having the higher side walls.

(28) An apparatus for forming an image on the sheet fed from the apparatus for feeding a sheet set forth in any one of modes (1) through (27), The apparatus for forming an image constructed according to the above mode (28) makes it easier to downsize the instant apparatus by virtue of the employment of the apparatus for feeding a sheet constructed according to any one of the preceding modes.

(29) An apparatus for forming an image using a removable process cartridge incorporating a developer developing an electrostatic latent image formed on a photoconductor, comprising the apparatus for feeding a sheet set forth in any one of modes (1) through (27), wherein the feeder tray of the apparatus for feeding a sheet is displaceable in a direction allowing the process cartridge to be attached to and removed from the apparatus for forming an image.

The apparatus according to the above mode (29) makes it easier to reduce a space within the apparatus for storage of the edge guides when the feeder tray is in the retracted position. This contributes to an enlargement in space within the apparatus for accommodating the process cartridge, for example.

The enlargement in space enables increase in size of a developing device available with in the above apparatus, the developing device being located within the process cartridge and incorporating a container for storing developer material. This makes it easier to increase a storage capacity of a container available within the apparatus for accommodating developer material.

Several presently preferred embodiments of the invention will be described in more detail by reference to the drawings in which like numerals, are used to indicate like elements throughout.

Described first schematically, each one of the embodiments described in greater detail below relates to a sheet feeding unit disposed for use in an image forming apparatus (a printer, for example) The sheet feeding unit includes a feeder tray having a sheet-loaded plane on which a sheet of paper is to be loaded.

The feeder tray is configured to be displaceable between a retracted or folded position (referred also to a non-working position, and an inoperative position) in which the feeder tray is retracted into the image forming apparatus, and an unfolded position (referred also to a working position, and an operative position) in which the feeder tray is protruded from the image forming apparatus.

The sheet feeding unit further includes a pair of retractable or tiltable edge guides (or side guides) mounted on the sheet-loaded plane for guiding the lateral edges of a sheet of paper moving in a feeding direction along a sheet travel path assigned onto the sheet-loaded plane. The pair of edge guides includes a pair of side walls opposed to each other, with the sheet travel path being interposed therebetween.

The sheet feeding unit further includes a supporting device supporting the edge guides pivotally about the respective axes parallel to the feeding direction, for rendering the edge guides to be retractable or tiltable.

The sheet feeding unit further includes a holder holding each one of the edge guides selectively in a standing position allowing the each edge guide to stand on the sheet-loaded plane, or in an inclined position allowing the each edge guide to be inclined to the standing position. The inclined position also means a retracted position of each of the edge guides.

The sheet feeding unit is operated in a manner that the each edge guide is situated in the standing position while the feeder tray is in the unfolded position, and that the each edge guide is pivoted from the standing position to the inclined position upon displacement of the feeder tray from the unfolded position to the retracted position.

FIG. 1 shows in perspective view a laser printer 1 as an image forming apparatus having a sheet feeding unit constructed in accordance with a first embodiment of the present invention.

The laser printer 1 has a body 4 which has a front panel 4*a*. The front panel 4*a* extends approximately vertically. The laser printer 1 includes a sheet feeding unit 2 disposed at the front panel 4*a* and incorporating a feeder tray 3.

The feeder tray 3 is configured to be displaceable between a retracted position in which the feeder tray 3 is retracted into an open recess 5 formed at the front panel 4*a* of the body 4, and an unfolded position in which the feeder tray 3 is protruded outward from the front panel 4.

Figure 2:
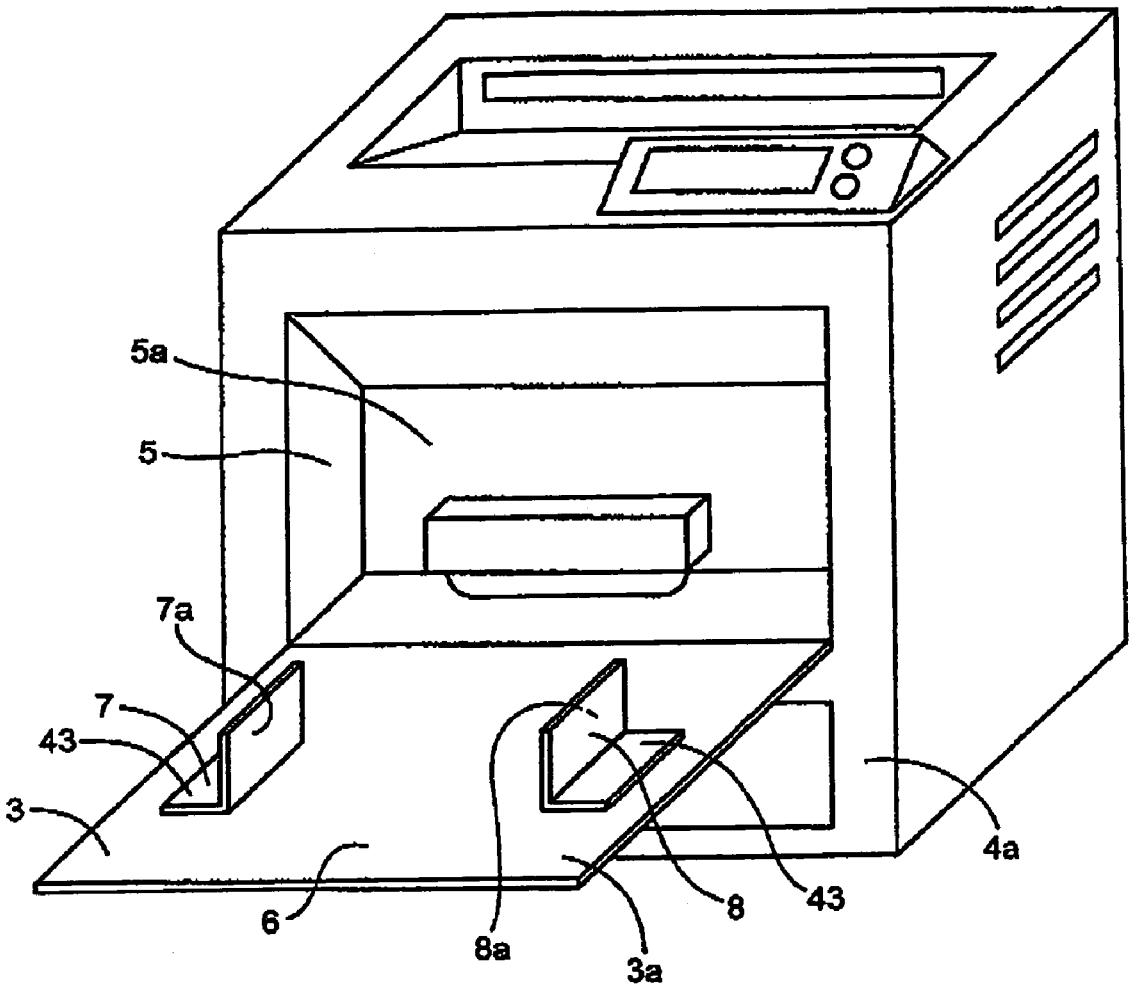
FIG. 2 is a perspective view illustrating the exterior of the laser printer shown in FIG. 1, with the feeder tray being in an unfolded position.

FIG. 1 shows in perspective view the laser printer 1 with the feeder tray 3 being in the retracted position, while FIG. 2 shows in perspective view the laser printer 1 with the feeder tray 3 being in the unfolded position allowing loading of a fresh sheet of paper into the feeder tray 3.

As shown in FIG. 2, the feeder tray 3 is pivotally linked at a base end 3*a* of the feeder tray 3, with a lower area of the open recess 5 of the body 4. The base end 3*a* is, for example, linked at both ends of the base end 3*a*, with lower ends of both side walls of the open recess 5 via a suitable pivotally-supporting mechanism such as a pair of bearings not shown.

The feeder tray 3 is displaced from the retracted position shown in FIG. 1 to the unfolded position shown in FIG. 2, as a result of a pivotal movement of the feeder tray 3 about the base end 3*a*. In the unfolded position, the feeder tray 3 is protruded approximately horizontally from the front panel 4*a*. In the protruded position, the feeder tray 3 is opened at an upper end of the feeder tray 3 in the unfolded position, allowing loading of a fresh sheet of paper into the feeder tray 3.

As shown in FIG. 2, the feeder tray 3 has a sheet-loaded plane 6 on which a pair of edge guides 7 and 8 is disposed. The pair of edge guides 7 and 8 includes a pair of side walls 7*a* and 8*a* disposed in parallel with the feeding direction FD for guiding the lateral edges of a sheet of paper. The side walls 7*a* and 8*a* are opposed to each other, with the travel path of the sheet of paper being interposed therebetween, and are movable perpendicularly to the feeding direction.

As shown in FIG. 2, the edge guides 7 and 8 in the standing position are projected from the sheet-loaded plane 6 within the plane perpendicular to the sheet-loaded plane 6 and parallel to the displacement direction (folding direction) of the feeder tray 3. The construction of the sheet feeding unit 2 including the pair of edge guides 7 and 8 will be described below in more detail.

Figure 3:
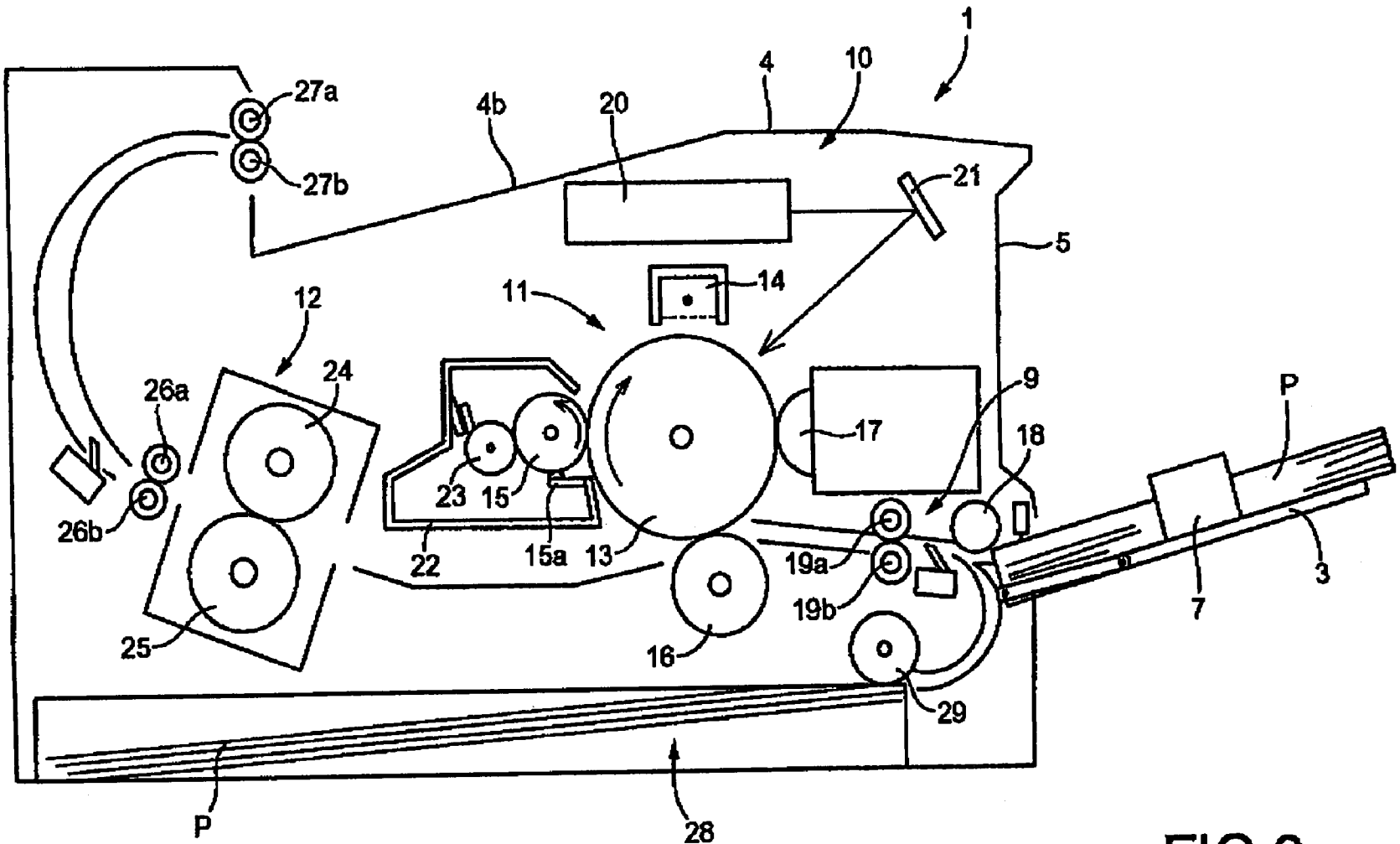
FIG. 3 is a sectional side view illustrating the laser printer shown in FIG. 1, with the feeder tray being in the unfolded position.
Figure 4:
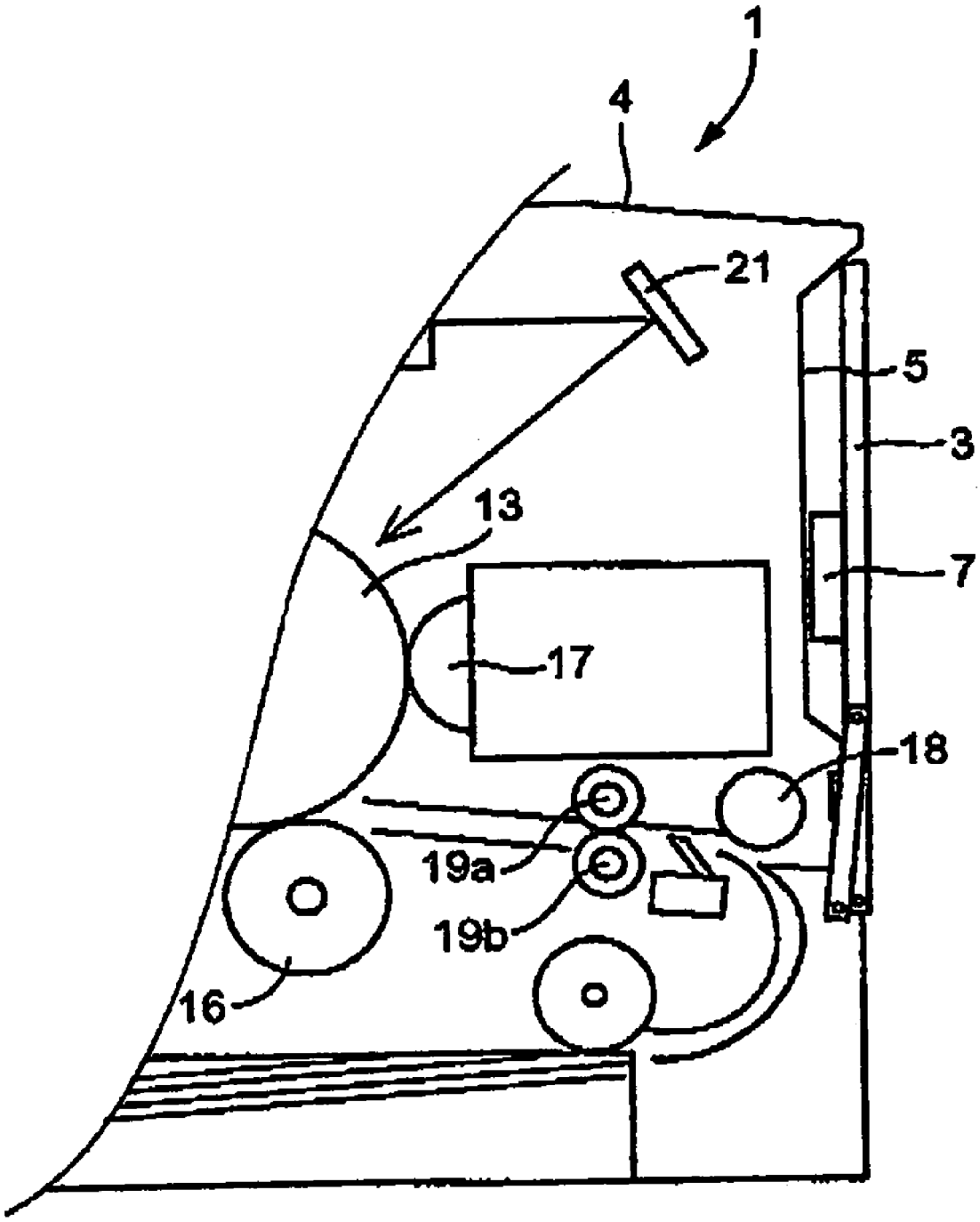
FIG. 4 is a fragmentary sectional side view illustrating the laser printer shown in FIG. 1, with the feeder tray being in the retracted position.

FIG. 3 shows in sectional side view the laser printer 1 with the feeder tray 3 being in the unfolded position allowing loading of a fresh sheet of paper into the feeder tray 3. FIG. 4 shows in sectional side view a relevant portion of the laser printer 1 with the feeder tray 3 being in the retracted position. The entire construction of the laser printer 1 will be described below in greater detail with reference to FIG. 3.

The laser printer 1 includes: the body 4; the sheet feeding unit 2 disposed at the front panel 4*a* of the body 4; a sheet transport mechanism 9 disposed within the body 4; a scanning unit 10; a process cartridge 11; a fuser unit 12; etc. There is formed at an upper surface of a rear portion 4*b* of the body 4*a* portion of the body 4 which functions as a tray for receiving printed sheets of paper.

In the laser printer 1, the scanning unit 10, the process cartridge 11, the fuser unit 12, etc. cooperate to correspond to a printing mechanism.

The process cartridge 11, which employs a cartridge-type in structure, includes a detachable casing. The casing contains: a photoconductive drum 13; a charger 14; a developer roller 15; a transfer roller 16; a cleaning roller 17, etc. not shown at a predetermined position within the body 4.

The feeder tray 3 constructing the sheet feeding unit 2, which is attached to the front panel 4*a* of the body 4, as described above with reference to FIGS. 1 and 2, is displaceable (foldable or retractable) in a direction allowing the process cartridge 11 to be removed from and attached to the laser printer 1, although the construction of the feeder tray 3 will be described below in more detail.

The sheet feeding mechanism 9 is configured to deliver the sheet P of paper fed from the feeder tray 3 to the process cartridge 11. To this end, the sheet feeding mechanism 9 includes: a pick-up roller 18 separating sheets of paper stacked on the feeder tray 3 for feeding individual sheets of paper one by one; and a pair of registration rollers 19*a* and 19*b*, both of which are disposed on a lower end side of the feeder tray 3. The registration roller 19*a* is a driving roller, while the registration roller 19*b* is a driven or idle roller.

While the feeder tray 3 is for use in feeding a stack of sheets of paper or an auto feeder, a feeder tray to which the present invention may be applied is not limited to the feeder tray 3, and may be one for use in manual feed.

As shown in FIG. 3, a sheet P of paper is fed from the feeder tray 3 via the pick-up roller 18 into the pair of registration rollers 19*a* and 19*b* for a registration of the leading edge of the sheet P of paper using the pair of registration rollers 19*a* and 19*b*, and is then delivered to the process cartridge 11.

As shown in FIG. 3, the scanning unit 10 includes: a laser emitting unit 20 disposed above the process cartridge 11 and having a polygon mirror, an object having a lens, etc., as not shown, a reflective mirror 21; etc. The scanning unit 10, as indicated by the solid arrow in FIG. 3, guides via the reflective mirror 21 a laser beam emitted from the laser emitting unit 20 to the outer periphery of the previously-charged photoconductive drum 13 in rotation within the process cartridge 11.

The scanning unit 10 illuminates with the laser beam the outer periphery of the photoconductive drum 13, such that the laser beam scans the photoconductive drum 13 at a high speed, thereby allowing the exposure of the photoconductive drum 13 to the laser beam. As a result, an electrostatic latent image is formed on the surface of the photoconductive drum 13.

As shown in FIG. 3, the process cartridge 11 incorporates within a casing not shown: the photoconductive drum 13; a Scorotron-type charger 14; the developer roller 15; the transfer roller 16; a cleaning roller 17; a toner box 22; a toner delivery roller 23; etc. The toner box 22 is replenished with fresh toner, with the process cartridge 11 being removed from the body 4.

The toner contained in the toner box 22 is delivered via the toner delivery roller 23 to the developer roller 15 on which the toner is then carried via a blade 15*a* so as to form a toner layer of a uniform thickness. The toner carried on the developer roller 15 is subsequently supplied to the photoconductive drum 13.

The electrostatic latent image formed on the surface of the photoconductive drum 13 is developed or visualized as a result of the movement of the toner from the developer roller 15 onto the electrostatic latent image. The visualized electrostatic latent image, namely, a toner image, is transferred to the sheet P of paper during the passing thereof through between the photoconductive drum 13 and the transfer roller 15. The sheet P of paper is then delivered to the fuser unit 12 for fusing the sheet P.

The toner remaining after the above transfer on the surface of the photoconductive drum 13 is temporarily collected by the cleaning roller 17, and is subsequently collected through the photoconductive drum 13 by the developer roller 15 operated in timed relation therewith.

The fuser unit 12 which is provided for heat-fusing the toner to the sheet P of paper, includes a heat roller 24, and a pressure roller 25 which presses the sheet P of paper to the heat roller 24.

The fuser unit 12 further includes a pair of exit rollers 26*a* and 26*b*, and a pair of exit rollers 27*a* and 27*b*, both of which are disposed downstream from the roller 24 and 25, and which allow the sheet P of paper exit from the body 4.

As shown in FIG. 3, an ordinary cassette 28 for auto feed is mounted at a lower portion of the body 4. The sheet P of paper in the cassette 28 is also fed via the pick-up roller 29 into the pair of registration rollers 19*a* and 19*b* for registration of the leading edge of the sheet P of paper using the pair of registration rollers 19*a* and 19*b*.

The sheet P of paper, upon registered, is fed by means of the pair of registration rollers.19*a* and 19*b* into the process cartridge 11 and the fuser unit 12 sequentially through the sheet travel path described above. Upon development and fusing, the sheet P of paper exits from the laser printer 4.

Figure 5:
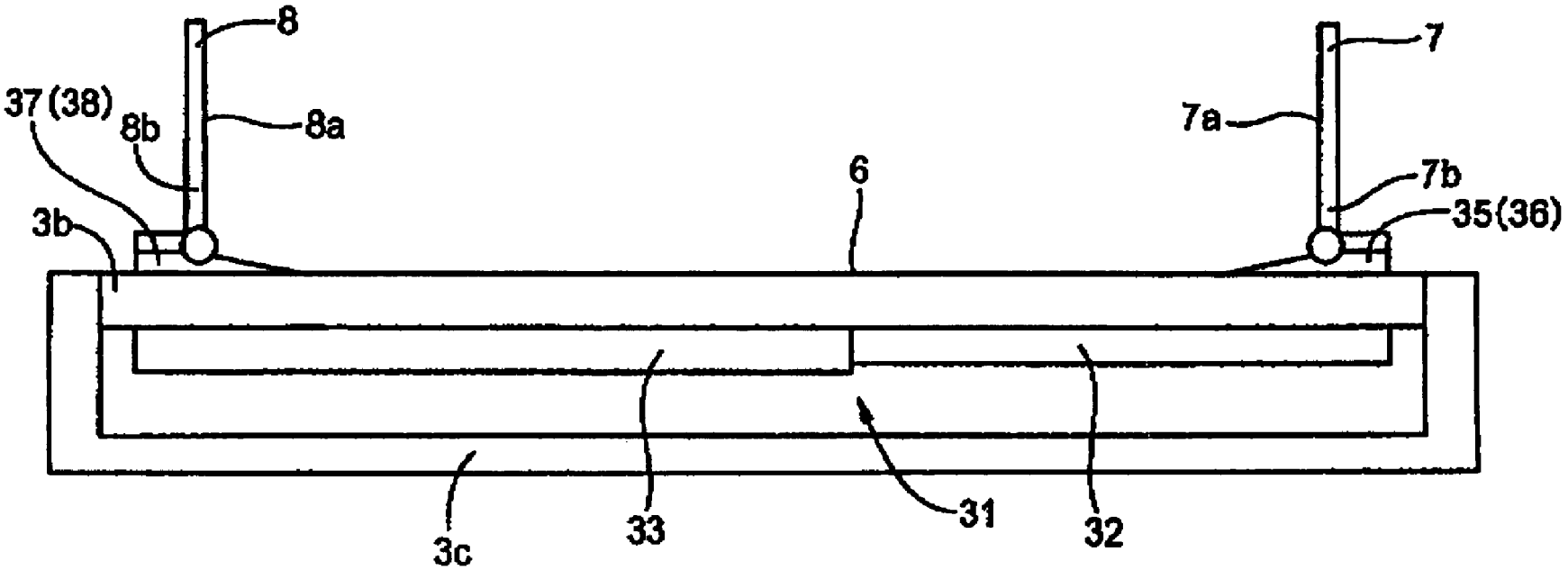
FIG. 5 is a front view illustrating the feeder tray shown in FIG. 1.
Figure 6:
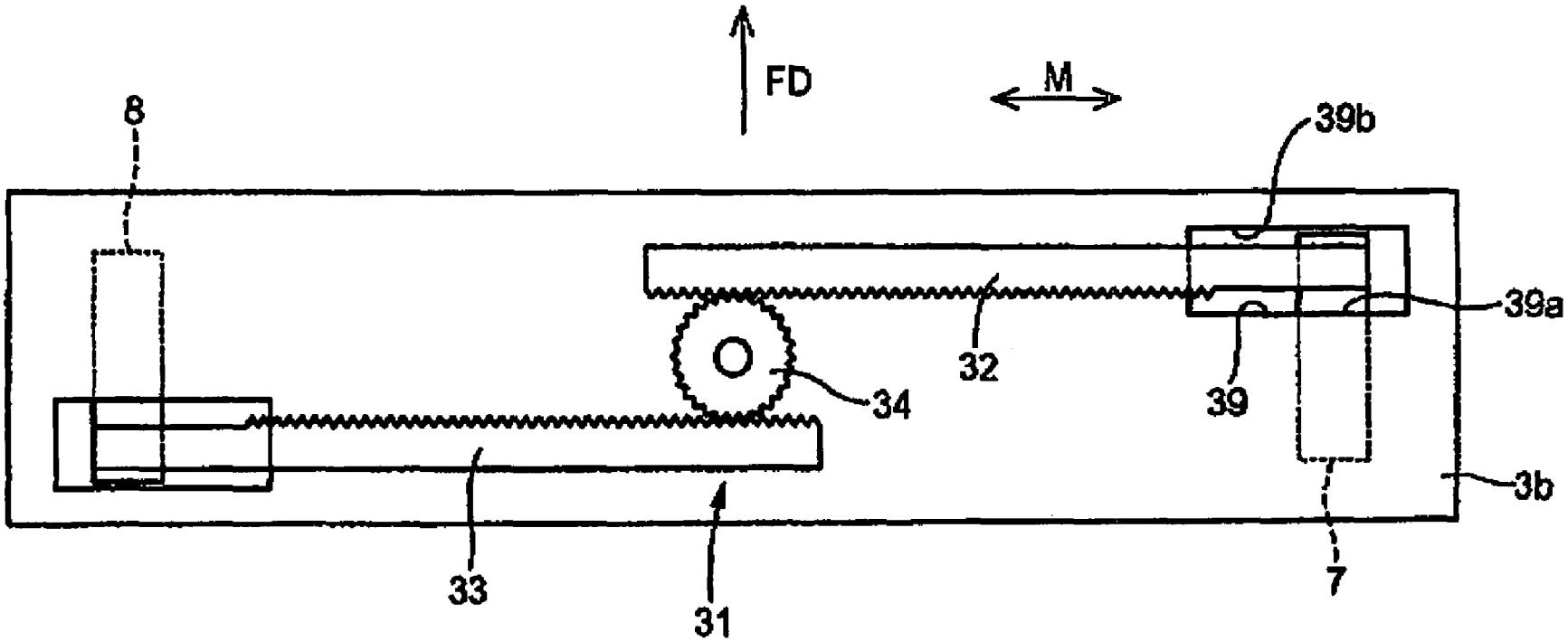
FIG. 6 is a rear view illustrating an upper plate of the feeder tray shown in FIG. 5.

Next, with reference to FIGS. 5-11, the sheet feeder unit 2 will be described in more detail. FIG. 5 shows a front view of the feeder tray 3 in the sheet feeder unit 2, while FIG. 6 shows a rear view of 30 an upper plate 3*b* forming a portion of the feeder tray 3.

As shown in FIG. 5, the feeder tray 3 includes the upper plate 3*b* and a lower support plate 3*c*. The lower support plate 3*c* supports the upper plate 3*b* so as to be apart from and opposed to the upper plate 3*b*. The sheet-loaded plane 6 is formed with the upper surface of the upper plate 3*b* (or a combination of the upper surface of the upper plate 3*b* and the upper surface of the lower support plate 3*c*)

On the upper plate 3*b* of the feeder tray 3, the pair of edge guides 7 and 8 made of a synthetic resin in the form of a thin plate is disposed to extend parallel to the feeding direction FD. The edge guides 7 and 8 have side walls 7*a* and 8*a* opposed to each other, for guiding a sheet of paper by regulating the width of the sheet travel path.

Figure 8:
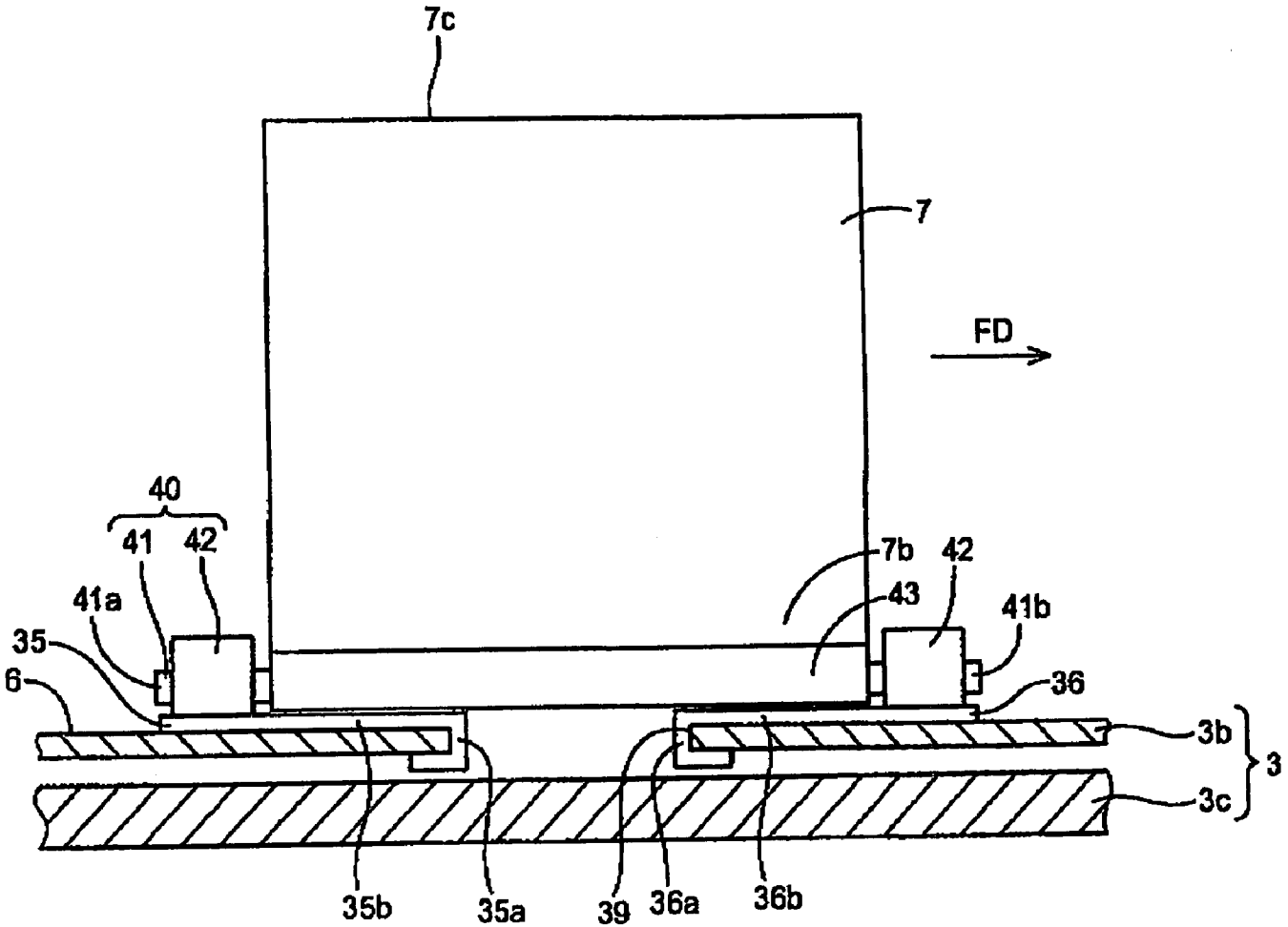
FIG. 8 is a view taken in the direction of arrow A in FIG. 7.

As shown in FIG. 8, a base end 7*b* of the edge guide 7 is supported by a pair of synthetic-resin-made attachment bases (sliders or movable bodies) 35 and 36 which is provided for enabling the edge guide 7 to move perpendicular to the feeding direction FD (i.e., the direction of arrow F in FIG. 8). Further, the attachment bases 35 and 36 are disposed to be separate from the base end 7*b* for allowing the edge guide 7 to be retractable or foldable with regard to the sheet-loaded plane 6.

Similarly, a base end 8*b* of the edge guide 8 is supported by a pair of synthetic-resin-made attachment bases (sliders or movable bodies) 37 and 38 (see FIGS. 7-11) separated from the base end 8*b* for allowing the edge guide 8 to move perpendicular to the feeding direction FD. Any of the attachment bases 35, 36, 37, and 38 is configured to be movable in the width-wise direction of the sheet P of paper.

As shown in FIG. 8, the attachment bases 35 and 36 are linked with each other by means of a supporting device 40 including a shaft 41, and a pair of bearings 42 and 42 through which the shaft 41 is passed at the respective ends thereof. The shaft 41 has an axis parallel to the feeding direction FD. Therefore, the edge guide 7 is pivotable about the axis, thereby allowing the edge guide 7 to be foldable,with regard to the sheet-loaded plane 6.

Similarly, the attachment bases 37 and 38, although are not shown, are each linked each other by means of the supporting device 40 including the shaft 41 and the pair of bearings 42 and 42. The shaft 41 has the axis parallel to the feeding direction FD. Therefore, the edge guide 8 is also pivotable about the axis of the shaft 41, thereby allowing the edge guide a to be foldable with respect to the sheet-loaded plane 6. The edge guide 8 is pivotable about the axis independently from the edge guide 7.

Figure 7:
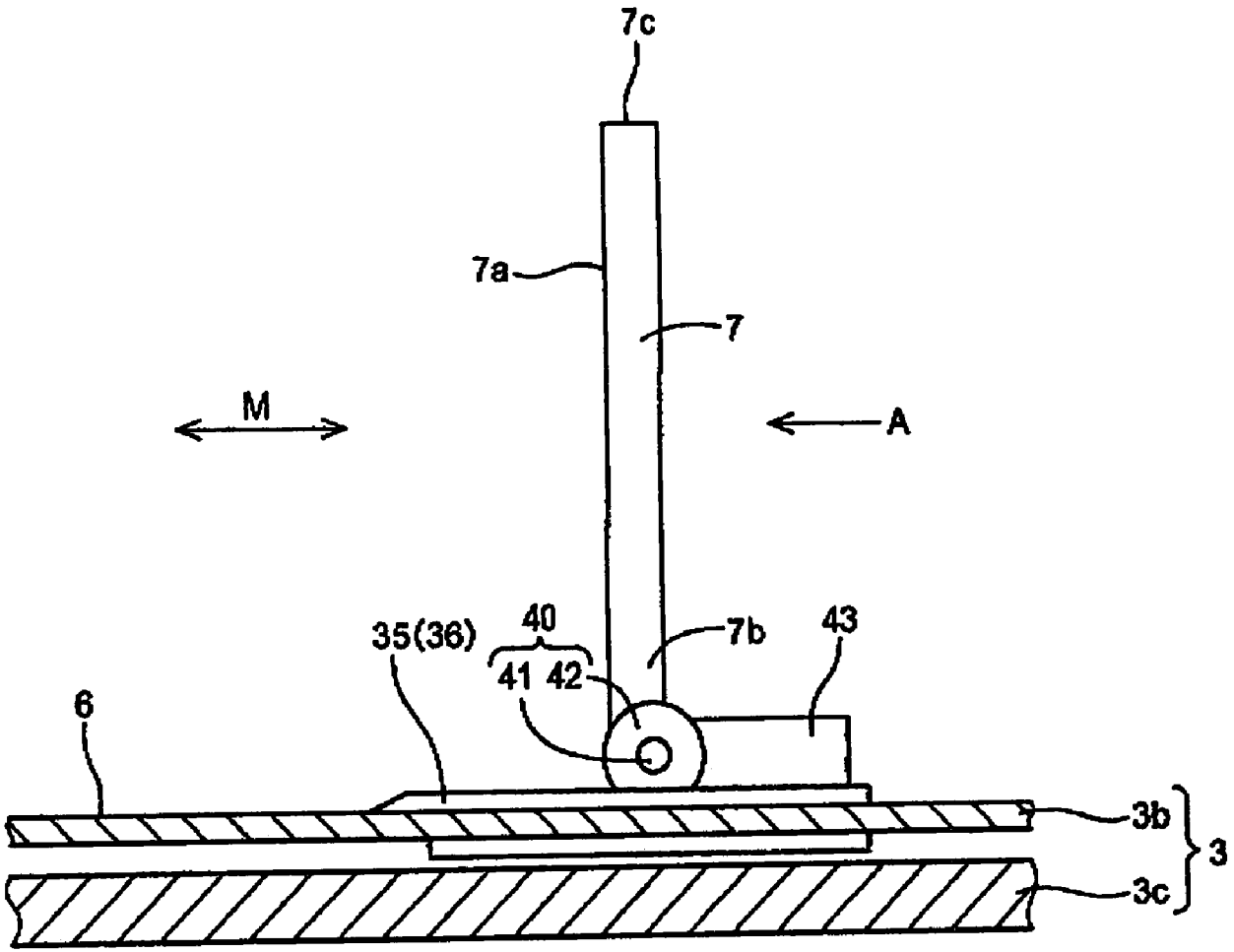
FIG. 7 is a front view of a representative one of edge guides of the feeder tray of the sheet feeding unit shown in FIG. 1.
Figure 9:
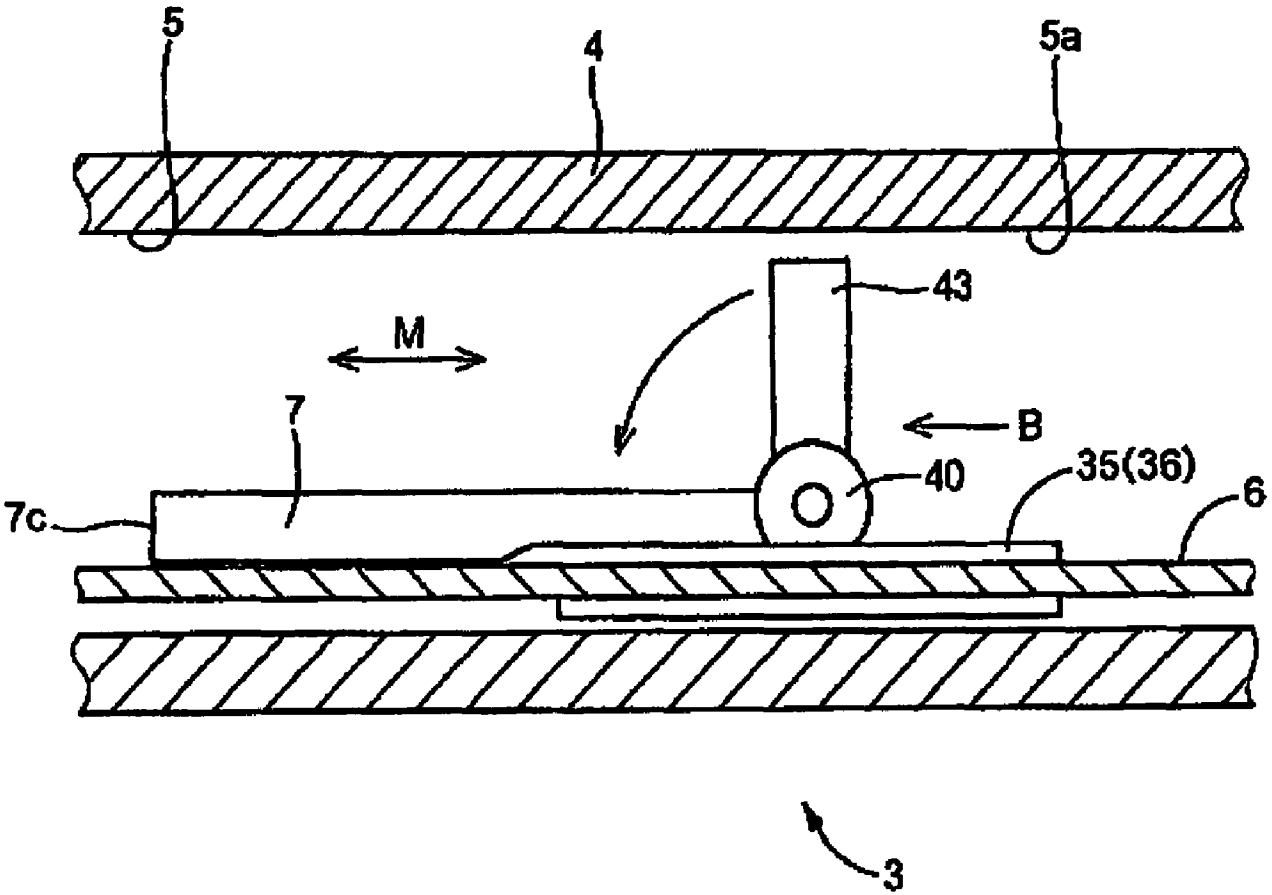
FIG. 9 is a front view illustrating the edge guide shown in FIG. 8, with the feeder tray being in the retracted position shown in FIG. 1.

As will be evident from FIG. 7, the disposition of the supporting device 40 in the vicinity of the upper surface of the upper plate 3*b,* that is, the sheet-loaded plane 6 reduces the length of a portion of each of the edge guides 7 and 8 which projects from the sheet-loaded plane 6, when in the inclined position as shown in FIG. 9. However, the suitable position of the supporting device 40 is not limited to the vicinity of the sheet-loaded plane 6, and the supporting device 40 may be disposed at an alternative position.

FIGS. 5 and 6 illustrate respectively in front view and rear view an exemplary construction of a linking mechanism 31 which enables the edge guides 7 and 6 to move in linked relation with each other. The linking mechanism 31, which is well-known, will be described as to only the basic construction thereof.

As shown in FIG. 5, the linking mechanism 31 is disposed within a space between the upper plate 3*b* and the lower support plate 3*c,* and a first rack 32 and a second rack 33, both of which are primary components of the linking mechanism 31, are attached to the back face of the upper plate 3*b.* As shown in FIG. 6, the first rack 32 is connected with the attachment bases 35 and 36(see FIGS. 7-11) which are connected with the base end 7*b* of the edge guide 7. On the other hand, the second rack 33 is connected with the attachment bases 37 and 38 which are connected with the base end 8*b* of the edge guide B. Any of the attachment bases 35, 36, 37, and 38 is configured to be movable in the width-wise direction of the sheet P of paper, that is, the lateral direction as viewed in FIG. 6.

As shown in FIG. 6, the first and second racks 32 and 33 are disposed to be apart from and opposed to each other at respective ear faces of the racks 32 and 33, and a pinion 34 is disposed between the racks 32 and 33 so as to fit with the racks 32 and 33 at the respective gear faces thereof. The pinion 34 is disposed rotatably about a stationary axis perpendicular to the sheet-loaded plane 6. Therefore, the pinion 34 is rotated in both clockwise-and-counterclockwise directions with the axis being fixed in position as the first and the second racks 32 and 33 move.

It is added that, for better illustration of edge guides 7 and 8 shown in FIGS. 5 and 6, FIG. 7-11 show representatively only the edge guide 7, without explicit representation of the counterpart edge guide 8 which is common in construction to the edge guide 7. The specific construction of the edge guide 8 can be reached by virtually modifying the illustrated construction of the edge guide 7 in consideration of the symmetric relation therebetween.

Because of the above-described construction of the linking mechanism 31, when the user moves one of the edge guides 7 (or 8) in the width-wise direction of the sheet P of paper outwardly of the central thereof, the other edge guide 8 (or 7) is moved in the opposite direction in linked relation with the one of the edge guides 7 (or 8), resulting in increase in the dimension of the sheet-loaded plane 6 of the feeder tray 3 in the width-wise direction. Conversely, when the user moves one of the edge guides 7 (or 8) in the width-wise direction of the sheet e of paper inwardly toward the center thereof, the other edge guide 8 (or 7) is moved in the opposite direction in linked relation with the one of the edge guides 7 (or 8), resulting in reduction in the dimension of the sheet-loaded plane 6 of the feeder tray 3 in the width-wise direction. In this manner, the user can adjust the feeder tray 3 more easily to variations in the width of the sheet P of paper.

Then, with reference to FIGS. 6-11, the construction of the edge guides 7 and 8 will be described in greater detail by means of an example of the edge guide 7. As described above, the edge guides 7 and 8 are common in construction to each other so that only the edge guide 7 is representatively illustrated.

Figure 10:
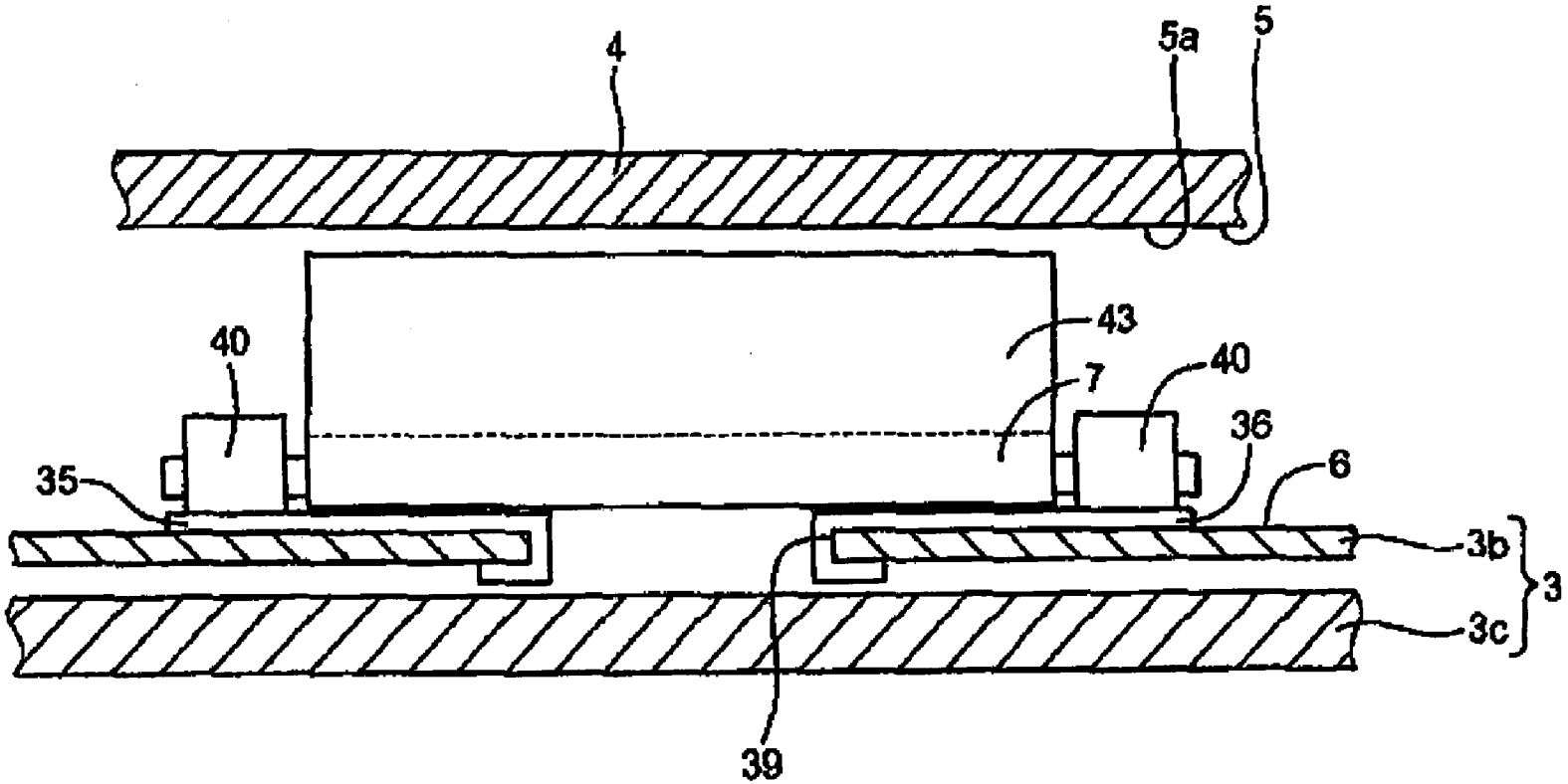
FIG. 10 is a view taken in the direction of arrow B in FIG. 9.
Figure 11:
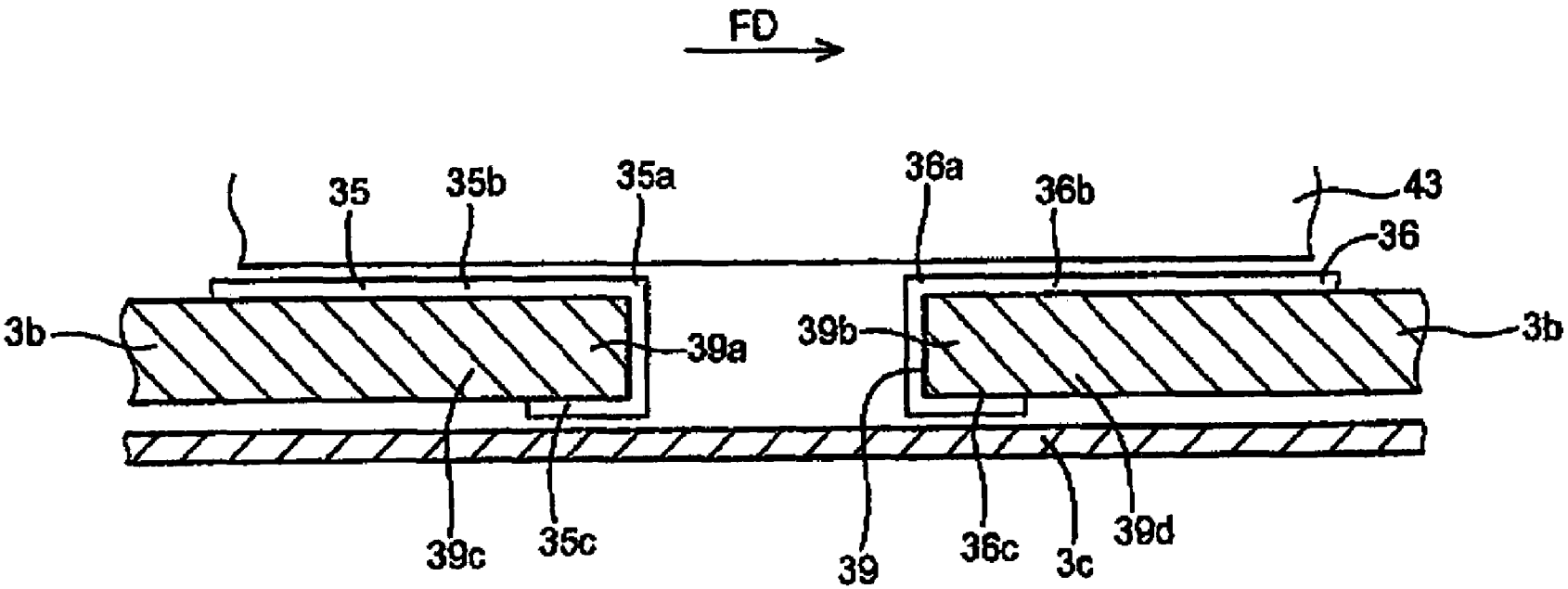
FIG. 11 is an enlarged view illustrating movable members shown in FIG. 10.

FIG. 6 illustrates in rear view the linking mechanism 31, FIG. 7 illustrates in front view the edge guide 7, and FIG. 8 is a side view taken in the direction of arrow A in FIG. 7. FIG. 9 illustrates in front view the edge guide 7 in the retracted position in which the feeder tray 3 is retracted within the open recess 5 of the body 4. FIG. 10 is a side view taken in the direction of arrow B in FIG. 9. FIG. 11 illustrates in enlarged view the relevant portions of the attachment bases 35 and 36 in FIG. 8.

As shown in FIG. 6, an elongated hole 39 is formed at the upper plate 3*b* of the feeder tray 3, for enabling the lateral movement of edge guide 7 in a direction perpendicular to the feeding direction FD (the direction indicated by arrow F in FIG. 6). As viewed from above, the elongated hole 39 is generally in the form of a rectangular extending in the perpendicular direction described above, that is, the moving direction of the edge guide 7 (the direction indicated by arrow M in FIG. 6).

More specifically, the elongated hole 39 is shaped generally as a rectangular constructed by a pair of longer sides extending in the moving direction M and a pair of shorter sides extending in the feeding direction FD. As shown in FIG. 6, the elongated hole 39 is formed at the upper plate 3*b* with a pair of hole forming portions 39*a* and 39*b* extending parallel to each other in the moving direction M.

As shown in FIG. 8, the attachment bases 35 and 36 each formed 30 in a thin plate are separated from the edge guide 7 at the base end 7*b* thereof, and are linked with the edge guide 7 via the supporting device 40. The attachment bases 35 and 36 are disposed to be overlaid on the upper surface of the upper plate 3*b,* and are arrayed to be spaced apart from each other in the feeding direction FD.

Fit portions 35*a* and 36*a,* each having a C-like shape cross-section, are formed at respective end portions of the attachment bases 35 and 36 which are apart from and opposed to each other in the feeding direction FD. As illustrated in enlargement in FIG. 11, the fit portions 35*a* and 36*a* are fitted with respective edge portions 39*c* and 39*d* of the hole forming portions 39*a* and 39*b* which are opposed to each other in the feeding direction FD, to thereby render the fit portions 35*a* and 36*a* to be slidable relative to the edge portions 39*c* and 39*d* in the moving direction M.

More specifically, as shown in FIG. 11, the edge portion 39*c* is fitted into the fit portion 35*a* of the attachment base 35, such that an upper surface portion 35*b* thereof is overlaid on the upper plate 3*b*. Similarly, the edge portion 39*d* is fitted into the fit portion 36*a* of the attachment base 36, such that an upper surface portion 36*b* there is overlaid on the upper plate 3*b*.

As shown in FIG. 8, the bearings 42 and 42, which support the shaft 41 rotatably, are fixed to the upper surface portions 35*b* and 36*b* of the attachment bases 35 and 36, respectively.

The supporting device 40, which is constituted by the assembly of the shaft Al and the bearings 42 and 42, connects pivotably the attachment bases 35 and 36 each formed in a thin plate and the edge guide 7.

The rack 32 (see FIG. 6) is linked with at least one of the attachment bases 35 and 36 for the edge guide 7, and the rack 33 is linked with at least one of the attachment bases 37 and 38 for the edge guide 8. The rack 33 is not illustrated in FIG. 6 by virtue of the common construction to the edge guide 7. It is well known that the arrangement makes any one of the edge guides 7 and 8 to be slidable.

It is added that, the bearings 42 and 42 may be integrally formed with the upper surface portions 35*b* and 36*b* of the attachment bases 35 and 36 using a synthetic resin. The bearings 42 and 42 may also be fixed to the upper surface portions 35*b* and 36*b* using an alternative suitable arrangement. The bearings 42 and 42 may be of any one of a rolling type and a sliding type, and may be modified in number or position as desired.

It is further added that, in the present embodiment, the fit portions 35*a* and 36*a* are formed by respective separate members so as to be separate from each other. Alternatively, the fit portions 35*a* and 36*a* may be integrally formed in one member (a sheet of a flat plate, for example).

As shown in FIG. 8, the shaft 41 extending parallel to the feeding direction FD is fixed with the edge guide 7 at the base end 7*b*, and is passed through the bearings 42 and 42, whereby the edge guide 7 is rotatably supported by the bearings 42 and 42.

In the present embodiment, the supporting device 40 is constructed, such that the shaft 41 includes extensions 41*a* and 41*b* which extend from the respective side faces of the edge guide 7 opposed to each other in the feeding direction FD, and which are supported rotatably by the bearings 42 and 42. The shaft 41, which is supported by the bearings 42 and 42 at the respective extensions 41*a* and 41*b*, is therefore easily assembled to the bearings 42 and 42.

The bearings 42 and 42 and the edge guide 7 may be integrally formed with each other using a synthetic resin. Alternatively, the bearings 42 and 42 and the edge guide 7 may be fixed to each other using an alternative suitable arrangement.

In the present embodiment, the shaft 41 is fixed with the edge guide 7, while the bearings 42 and 42 are fixed with the attachment bases 35 and 36. Conversely, the shaft 41 may be fixed with the attachment bases 35 and 36, while the bearings 42 and 42 may be fixed with the edge guide 7. That is, it is enough that the edge guide 7 is pivotable relative to the attachment bases 35 and 36.

As shown in FIG. 7, the edge guide 7 is generally L-shaped as viewed in the direction of the pivot axis of the edge guide 7. More specifically, the edge guide 7 is constructed so as to include the side wall 7*a* for guiding a sheet of paper, and a bottom wall 43 projecting from the side wall 7*a* at the base end 7*b* of both the side wall 7*a*. The bottom wall 43 projects outwardly of the pivot axis of the base end 7*b* in the direction away from the sheet-loaded plane 6. The bottom wall 43 projects from the above-mentioned pivot axis at about 90 degrees to the side wall 7*a*.

The bottom wall 43 allows the side wall 7*a* to be inclined from the standing position in the direction closer to the sheet-loaded plane 6. However, even if the side wall 7*a* attempts to be inclined from the standing position in the opposite direction, the bottom wall 43 abuts the attachment bases 35 and 36 at the lower surface of the bottom wall 43, to thereby inhibit the side wall 7*a* from being inclined from the standing position in the direction away from the sheet-loaded plane 6.

Thus, the bottom wall 43 allows the edge guide 7 to be inclined closer to the sheet-loaded plane 6, while inhibits the edge guide 7 from being inclined in the direction away from the sheet-loaded plane 6, to thereby function as a pivotal-direction limiter which limits a pivotal direction of the edge guide 7, and also, as a holder which holds the edge guide 7 in the standing position.

More specifically, it is the pivotal movement of the edge guide 7 about the shaft 41 in the counterclockwise direction as viewed in FIG. 7 that the bottom wall 3 allows. The allowed pivotal movement means an inclination of the edge guide 7 from the standing position as illustrated, toward the left-hand side of FIG. 7. On the other hand, it is the pivotal movement of the edge guide 7 about the shaft 41 in the clockwise direction as viewed in FIG. 7 that the bottom wall inhibits. The inhibited pivotal movement means an inclination of the edge guide 7 from the standing position as illustrated, toward the right-hand side of FIG. 7.

As described above, the bottom wall 43 has the function to limit the pivotal direction of the edge guide 7. Further, the bottom wall 43 is configured to establish the maximum limit of pivotal-angle of the edge guide 7 so that the side wall 7*a*, which limits the width of the sheet travel path, extends perpendicular to the sheet-loaded plane 6 at the standing position of the edge guide 7, as viewed in the feeding direction FD.

As shown in FIG. 7, the supporting device 40 and the bearings 42 and 42, which connect rotatably the edge guide 7 and the attachment bases 35 and 36 with each other, are disposed not to project from the surface of the side wall 7*a* closer to the sheet-loaded plane 6 (toward the left-hand side of FIG. 7). More specifically, the supporting device 40 may be disposed to have a tangential plane at the top of the circumference of the supporting device 40 in coplanar relationship with the surface of the side wall 7*a*, or may be deviated from the surface of the side wall 7*a* away from the sheet-loaded plane 6 (toward the right-hand side of FIG. 7).

The above arrangement is employed to avoid the loading of a sheet P of paper on the sheet-loaded plane 6 from being interfered by the supporting device 40. The arrangement is achieved by optimizing the outer dimension and/or the position of the pivot axis of the supporting device 40, for example.

It is added that, although, in the present embodiment, the above-described pivotal-direction limiter is in the form of the bottom wall 43 extending from the base end 7*b* of the edge guide 7 generally perpendicularly thereto, is not limited in construction, the limiter may be modified to one formed at the attachment bases 35 and 36 so as to limit the pivotal direction of the edge guide 7, for example.

In any case, the pivotal-direction limiter is not limited in construction as long as it performs the function of limiting the pivotal direction of the edge guide 7.

The direction in which the edge guide 7 is inclined from the standing position may be selected, as the direction away from the sheet-loaded plane 6, or may also be selected as the direction closer to the sheet-loaded plane 6, like in the present embodiment.

The latter arrangement, as compared with the former arrangement, allows an easier downsizing of the feeder tray 3 with respect to the width dimension thereof, wherein the feeder tray 3 is constructed so as to contain the entirety of the edge guide 7 at the inclined position thereof. In the case of the latter arrangement, similarly with the edge guide 7, the counterpart edge guide 8 is preferably configured such that the direction in which the edge guide 8 is inclined from the standing position coincides with the direction closer to the sheet-loaded plane 6.

Further, in the present embodiment, the edge guides 7 and 8 are each tiltable and also movable in the direction in which the edge guide 7 and 8 are opposed to each other, namely, in the direction perpendicular to the feeding direction FD. Alternatively, the edge guide 7 and 8 may be each configured such that the corresponding supporting device 40 is mounted on the feeder tray 3 without intervention of the attachment bases 35 and 36, so that the edge guide 7 and 8 is tiltable but not movable, for example.

Then, with reference to FIGS. 9 and 10, the retraction of the feeder tray 3 into the open recess 5 of the front panel 4*a* of the body 4 will be described below. FIG. 9 illustrates the feeder tray 3 together with the front panel 4*a* in a fragmentary sectional front view, while FIG. 10 illustrates the feeder tray 3 and the front panel 4*a* in a view taken in the direction of arrow B in FIG. 9.

For the feeder tray 3 to be retracted into the open recess 5, as shown in FIGS. 9 and 10, the user first pivots the edge guide 7 (in common to the edge guide 8) from the standing position toward the inclined position, namely, in the direction indicated by the arrow in FIG. 9. The edge guide 7 is eventually tilted to the inclined position. The edge guide 7, as described above, is limited in pivotal direction by the bottom wall 43 functioning as the pivotal-direction limiter to inhibit the pivotal movement from the standing position in the direction opposite to the direction of the arrow indicated in FIG. 9, resulting in a unilateral tilting direction indicated by the arrow in FIG. 9.

With the edge guide 7 being in the inclined position, the user retracts the feeder tray 3 into the open recess 5 by pivoting the feeder tray 3 closer to the open recess 5. Accordingly, the depth of the open recess 5 of the body 4 is deep enough if it has a minimum dimension conforming to the length of the bottom wall 43.

Now, with reference to FIG. 12, the edge guide 7 will be described in comparison with a conventional edge guide.

Figure 12:
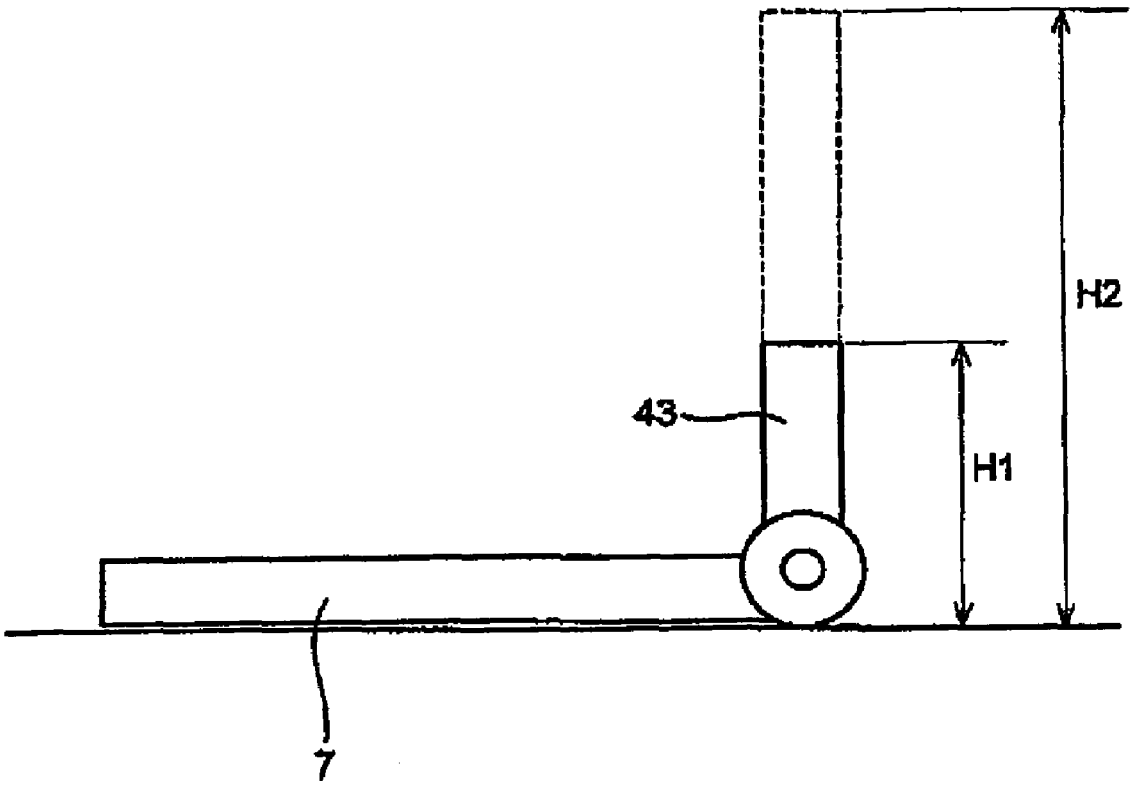
FIG. 12 is a front view illustrating the edge guide shown in FIG. 7 in comparison with a conventional edge guide for better understanding of a difference therebetween in dimension required for storage of the edge guides.

Conventionally, an edge guide was rigidly fixed to a feeder tray, and as a result, the feeder tray 3 was required to be retracted into the open recess 5 with the edge guide 7 being in the standing position as represented by the broken line in FIG. 12. For this reason, conventionally, the open recess 5 was required to be dimensioned in depth equal to or longer than the height dimension H2 of the edge guide 7.

Conversely, in the present embodiment, the user can retract the feeder tray 3 into the open recess. 5 with the edge guide 7 being laid on the feeder tray 3 represented by the solid line in FIG. 12.

Accordingly, the open recess 5 of the body 4 is deep enough if it has a minimum dimension conforming to the height dimension H1 of the bottom wall 43. As a result, the open recess 5 is able to reduce in depth by the difference the dimension H2 minus the dimension H1, leading to downsize the body 4.

For the laser printer 1 to be replenished with a sheet P of paper by loading the sheet P of paper on the feeder tray 3, the user unfolds the feeder tray 3 away from the body 4, and then manually raises up the edge guide 7 with the feeder tray 3 being in the unfolded position.

In the present embodiment, the user's operations of the feeder tray 3 and the edge guide 7 are independent of each other. However, as described later in a second embodiment of the present invention, a disposition of a biasing mechanism BM biasing normally the edge guide 7 toward the standing position, between the attachment bases 35 and 36 and the edge guide 7, enables the edge guide 7 to pivot automatically from the inclined position to the standing position in linked relation with the user's operation of the feeder tray 3.

Although the operation of the feeder tray 3 has been described above by way of an example of the edge guide 7, it is easily understood that the edge guide 7 and the counterpart edge guide 8 are common in construction and operation, which is applicable to alternative embodiments of the present invention described later.

As will be better understood from the above description, the present embodiment facilitates the downsizing of the laser printer 1.

The present embodiment allows an easier downsizing of the laser printer 1 without affecting clearances between the adjacent ones of the inside components of the laser printer 1. More specifically, the downsizing of the laser printer 1 does not require arranging two components such as the toner box 22 and the fuser unit 12 which are not favorable to be arranged within the laser printer 1 so as to be closely spaced away from each other, such that these two components become excessively closely spaced away from each other.

In general, in a large-sized printer, there is an adequate clearance between the toner box 22 and the fuser unit 12, for avoiding the toner box 22 from being heated by the fuser unit 12. By contrast, in a small-sized printer, the downsizing thereof tends to sacrifice the clearance between the toner box 22 and the fuser unit 12 within the small-sized printer.

Nevertheless, even when the laser printer 1 is small-sized, the present embodiment facilitates the downsizing thereof while ensuring an adequate clearance between the toner box 22 and the fuser unit 12. The downsizing of the laser printer 1 does not arouse any concern for a heat problem in designing the laser printer 1.

Further, the present embodiment allows the downsizing of the laser printer 1 without affecting in size the inside components of the laser printer 1. Accordingly, the downsizing of the laser printer 1, because of no need to reduce in size the toner box 22, is achieved so as to allow an adequate capacity of the toner box 22 for accommodating toner to be ensured as with a conventional laser printer.

As will be readily understood from the above description, in the present embodiment, the laser printer 1 constitutes an example of the "processing device" set forth in mode (1), and the sheet feeding unit 2 constitutes an example of the "apparatus for feeding a sheet of paper" to which mode (1) is directed.

Further, in the present embodiment, the supporting device 40 includes the combination of the shaft 41 and the bearings 42 and 42 as an example of the "holding mechanism" set forth in mode (2) or (3). The attachment bases 35, 36, 37, and 38 each constitute an example of the "moving body" set forth in mode (7). The bottom wall 43 constitutes an example of the, "pivotal-direction limiter" set forth in mode (12) or (13), and also constitutes an example of the "bend" set forth in mode (14).

Then, with reference to FIGS. 13-16, a second embodiment of the present invention will be described.

In view of the fact that the present embodiment is common in basic construction to the first embodiment, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

Further, in view of the fact that the edge guides 7 and 8 are structurally common to each other in the present embodiment like in the first embodiment, only the edge guide 7 will be representatively illustrated and described.

Figure 13:
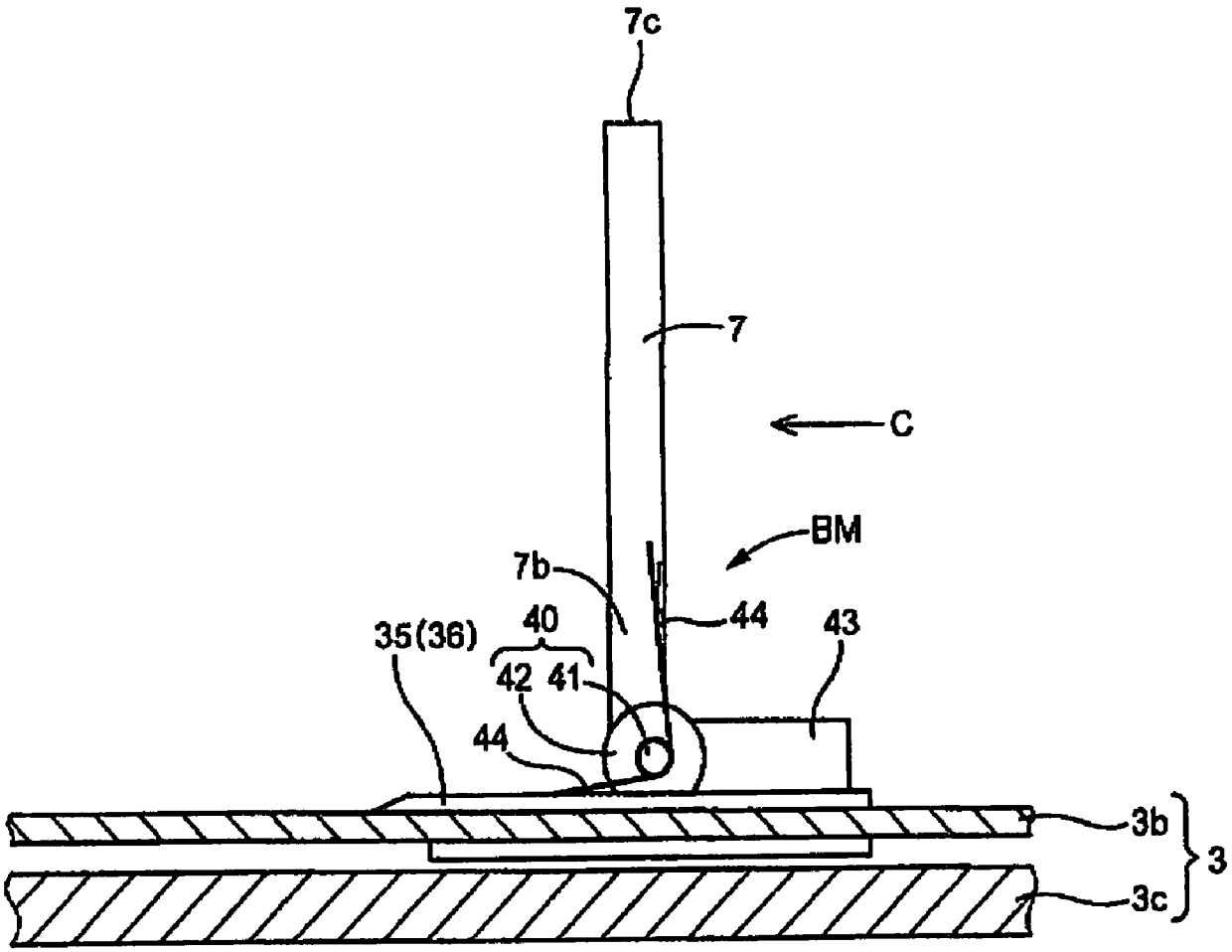
FIG. 13 is a front view illustrating a representative one of edge guides of a feeder tray of a sheet feeding unit constructed according to a second embodiment of the present invention.
Figure 14:
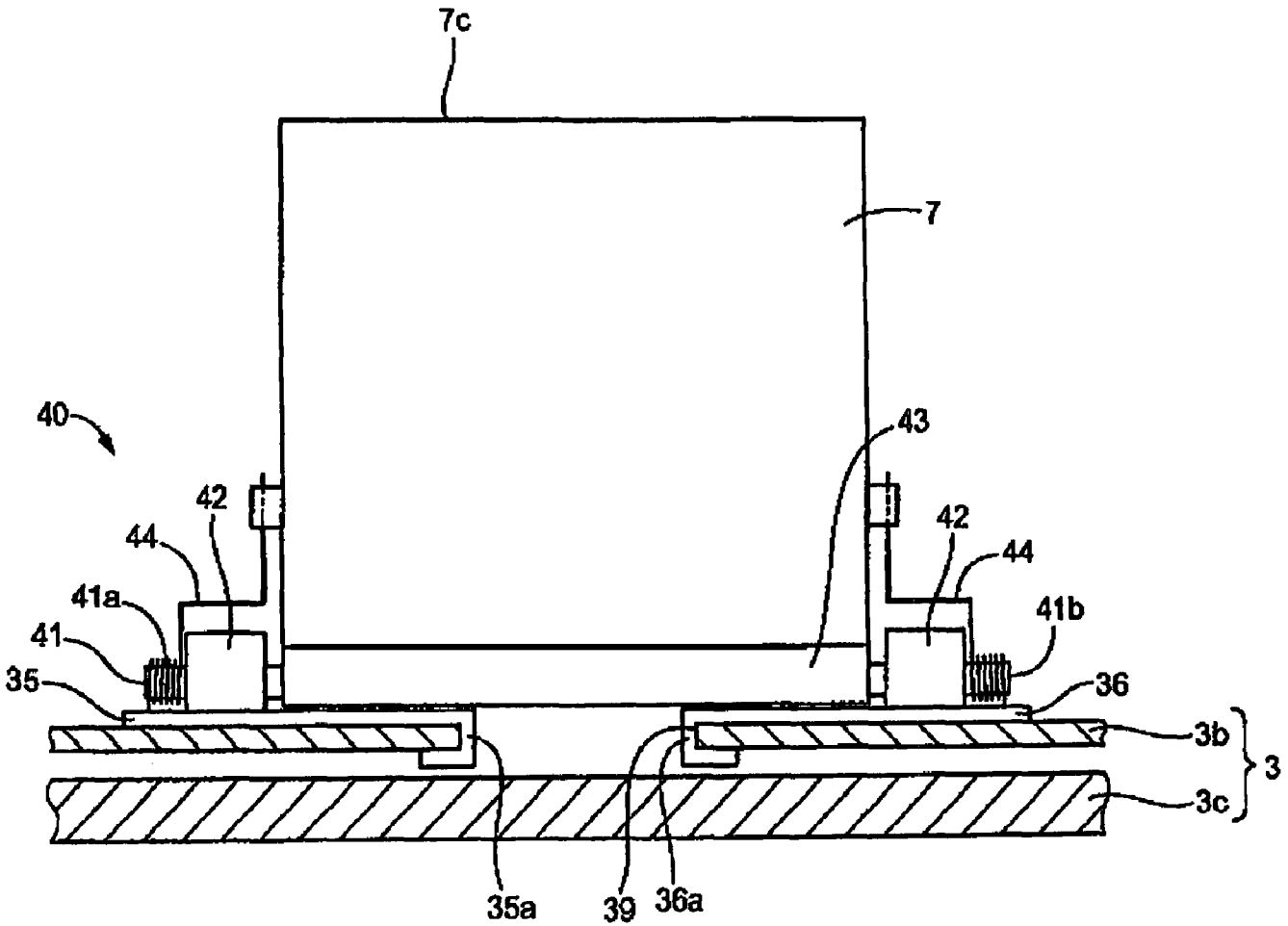
FIG. 14 is a view taken in the direction of arrow C in FIG. 13.
Figure 15:
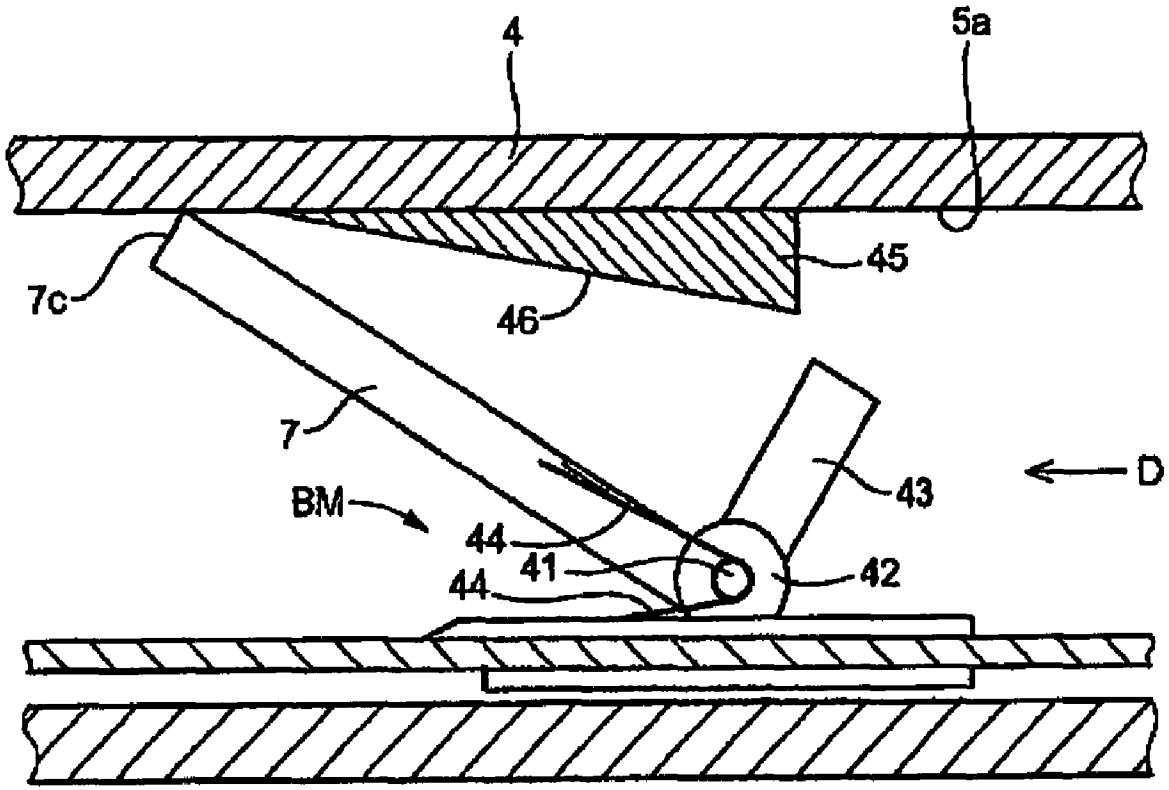
FIG. 15 is a front view illustrating the edge guide shown in FIG. 13, with the feeder tray being in a retracted position.
Figure 16:
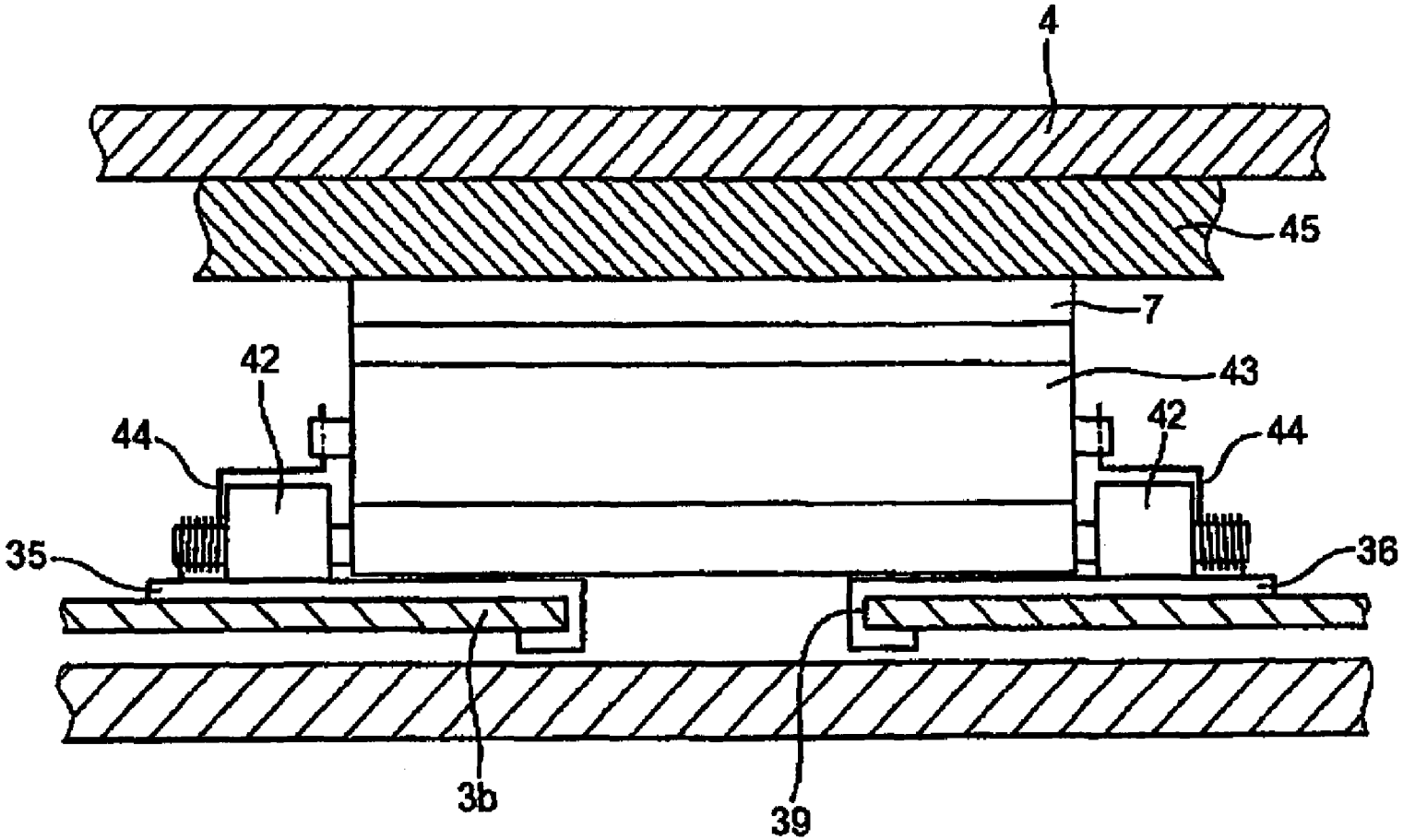
FIG. 16 is a view taken in the direction of arrow D in FIG. 15.

FIG. 13 is a front view illustrating the edge guide 7 in accordance with the present embodiment, and FIG. 14 shows the edge guide 7 in a view taken in the direction of arrow C in FIG. 13. FIG. 15 is a front view illustrating the edge guide 7, with the feeder tray 3 being retracted in the open recess 5 of the body 4, and FIG. 16 shows the edge guide 7 in a view taken in the direction of arrow D in FIG. 15.

As shown in FIGS. 13 and 14, in the present embodiment, biasing mechanisms BM are provided between the edge guide 7 and the corresponding respective attachment bases 35 and 36 to bias the edge guide 7 toward the standing position. Each of the biasing mechanisms BM may be formed in a leaf spring, a wire-like spring, a coil spring, or any one of other types of elastic members.

In the present embodiment, the each biasing mechanism BM includes a coil-like center section wounded around the shaft 41, and two wire-like springs 44 and 44 extending away from the center section at both ends thereof. One of the wire-like springs 44 and 44 is engaged at the top end thereof with a corresponding one of the attachment bases 35 and 36, while the other of the wire-like springs 44 and 44 is engaged at the top end thereof with the edge guide 7. The edge guide 7 is always elastically biased by the thus-constructed biasing mechanisms BM toward the standing position.

As shown in FIG. 15, a projection 45 is formed on the abutting surface 5*a* of the open recess 5 of the body 4 at a position which one of both corners of a top end 7*c* of the edge guide 7 (hereinafter, referred to as "contact corner") is to be brought into contact with the abutting surface 5*a*. The projection 45 includes a contact surface 46 opposed to the edge guide 7.

The contact surface 46 is inclined to the abutting surface 5*a* so as to face the above-mentioned contact corner. A reaction force is applied from the contact surface 46 to the contact corner, upon abutting of the contact corner against the contact surface 46. The reaction force is applied along a line not passing through the pivot axis of the edge guide 7, resulting in application of a moment to the edge guide 7 in a direction allowing the edge guide 7 to be tilted from the standing position to the inclined position.

In the present embodiment, the contact surface 46 is formed in a flat plane having such a slope that the height of the flat plane measured from the abutting surface 5*a* is continuously and linearly reduced as the edge guide 7 is tilted from the standing position toward the inclined position. However, the profile of the contact surface 46 is not restrictive, and it may be modified to an arc-shaped surface allowing the height of the flat plane is continuously and non-linearly changed. In any case, it is enough only if the contact surface 46 has a plane so inclined to the abutting surface 5*a* as to allow the edge guide 7 to be tilted from the standing position to the inclined position.

Next, with reference to FIGS. 13 and 14, the retraction of the feeder tray 3 into the open recess 5 of the body 4 will be described.

As shown in FIGS. 13 and 14, as a result of the approach of the feeder tray 3 to the open recess 5 with the edge guide 7 being in the standing position, the top end 7*c* of the edge guide 7 is first brought into contact at the aforementioned contact corner thereof with the contact surface 46 of the projection 45 of the open recess 5.

The edge guide 7 is so limited in an allowable pivotal-direction by the bottom wall 43 functioning as the aforementioned pivotal-direction limiter, as to inhibit the edge guide 7 from being pivoted away from the inclined position. Therefore, the edge guide 7 is rendered to be pivotable only in the tilt direction indicated by the curved arrow in FIG. 9. As a result, while the top end 7*c* of the edge guide 7 is being guided by the contact surface 46 of the projection 45, the edge guide 7 is pivoted about the centerline of the supporting device 40 in the aforementioned tilt direction. Once the feeder tray 3 has been completely retracted into the open recess 5, the edge guide 7 is accommodated within the open recess 5 with the edge guide 7 being in the inclined position.

Then, once the feeder tray 3 has been unfolded away from the open recess 5, the edge guide 7 is automatically pivoted form the inclined position toward the standing position by virtue of the biasing force of the biasing mechanisms BM. While the edge guide 7 is in contact with the contact surface 46, as the feeder tray 3 is increasing the unfolding angle thereof measured from the body 4, the edge guide 7 is increasing the pivot angle thereof measured from the inclined position. Once the edge guide 7 terminates the contact with the contact surface 46, the edge guide 7 completely returns to the standing position.

As will be readily understood from the above description, in the present embodiment, the biasing mechanisms BM each constitute an example of the "holding mechanism" set forth in mode (4), the top end 7*c* and the projection 45 forming the inclined contact surface 46 together constitute an example of the "tilting mechanism" set forth in mode (5) or (6), and also together constitute an example of the "translating mechanism" set forth in mode (17).

Then, with reference to FIGS. 17-20, a third embodiment of the present invention will be described.

In view of the fact that the present embodiment is common in basic construction to the first embodiment, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

Further, in view of the fact that the edge guides 7 and 8 are structurally common to each other in the present embodiment like in the first embodiment, only the edge guide 7 will be representatively illustrated and described.

Figure 17:
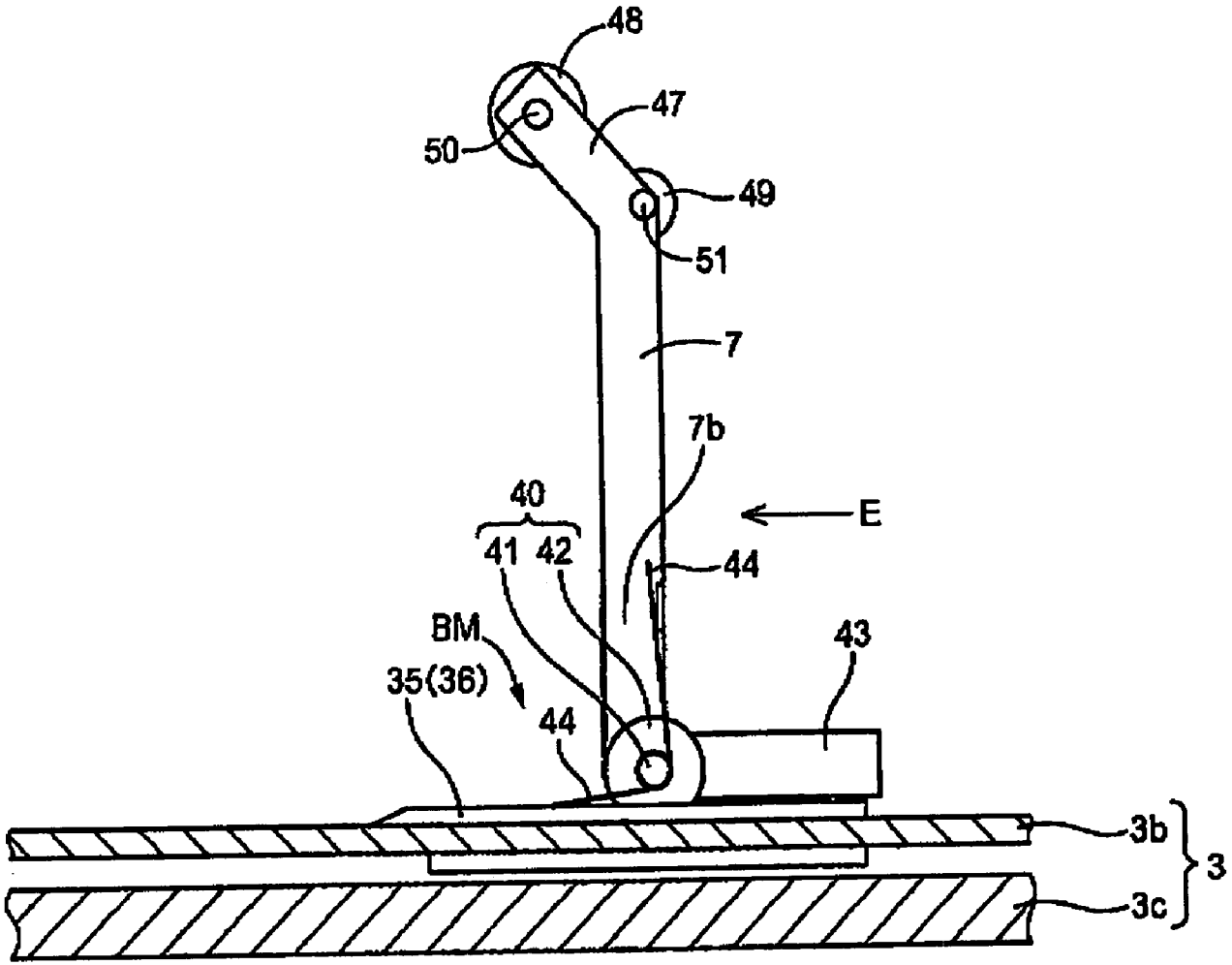
FIG. 17 is a front view illustrating a representative one of edge guides of a feeder tray of a sheet feeding unit constructed according to a third embodiment of the present invention.
Figure 18:
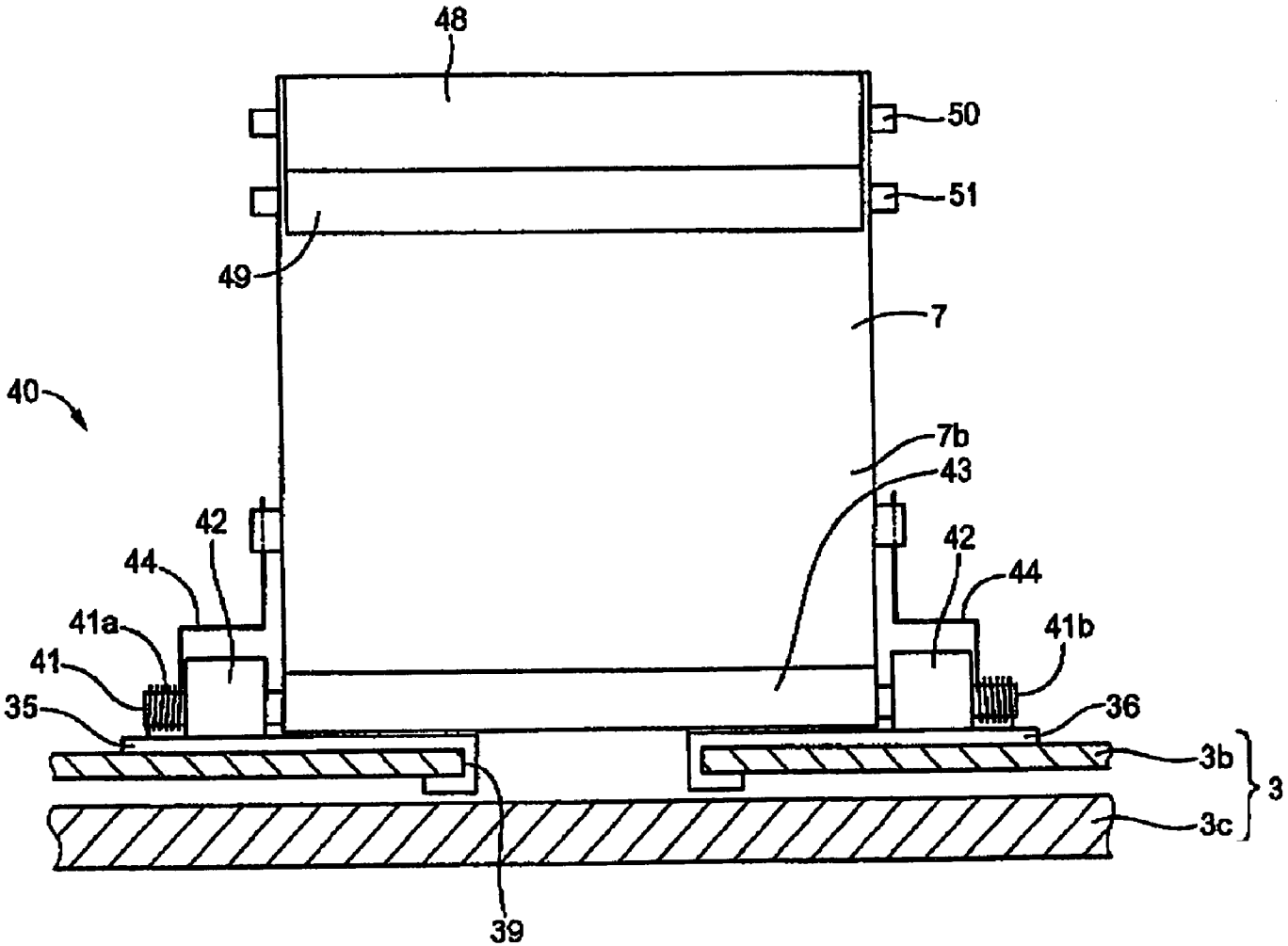
FIG. 18 is a view taken in the direction of arrow E in FIG. 17.
Figure 19:
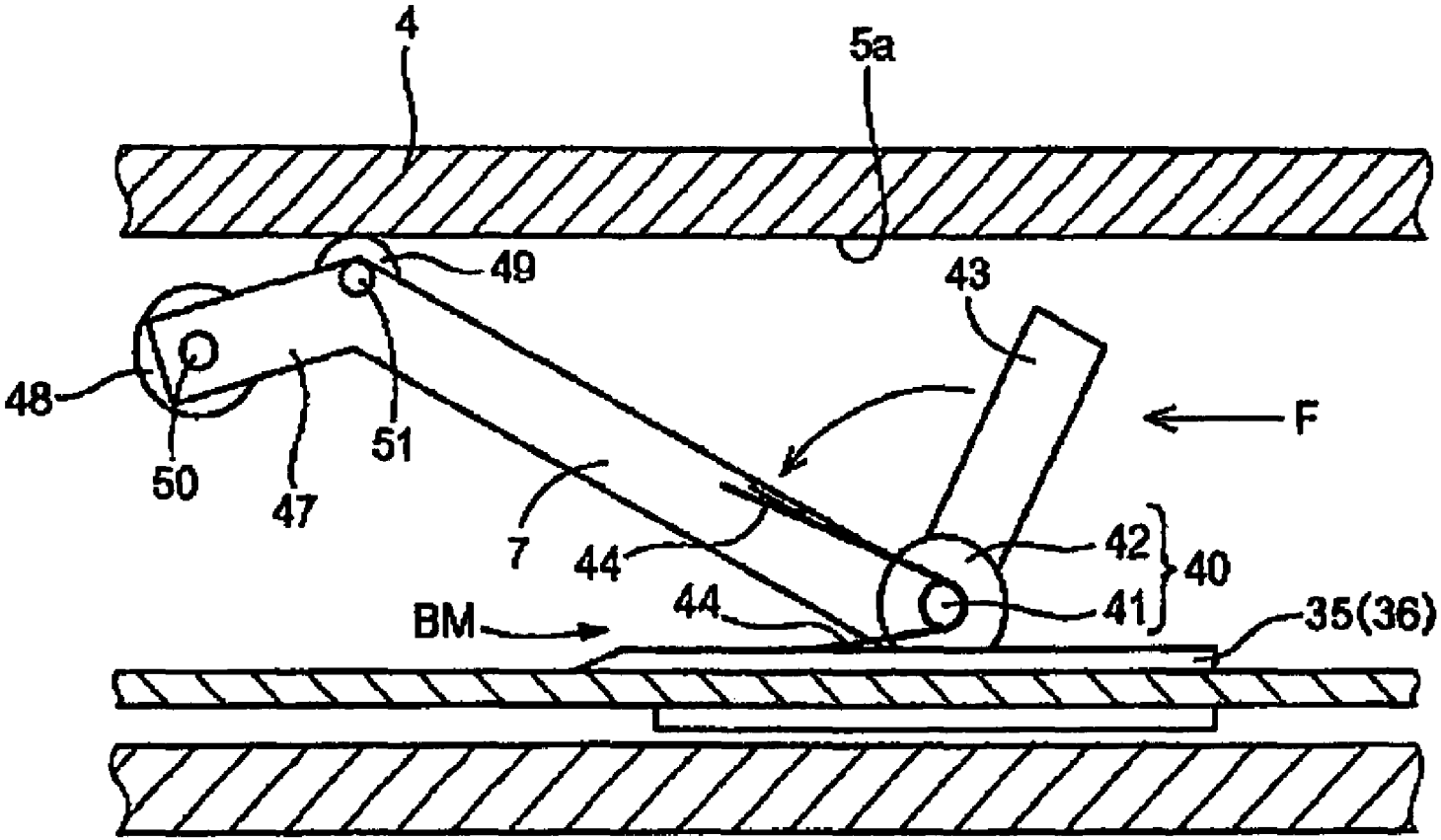
FIG. 19 is a front view illustrating the edge guide shown in FIG. 17, with the feeder tray being in a retracted position.
Figure 20:
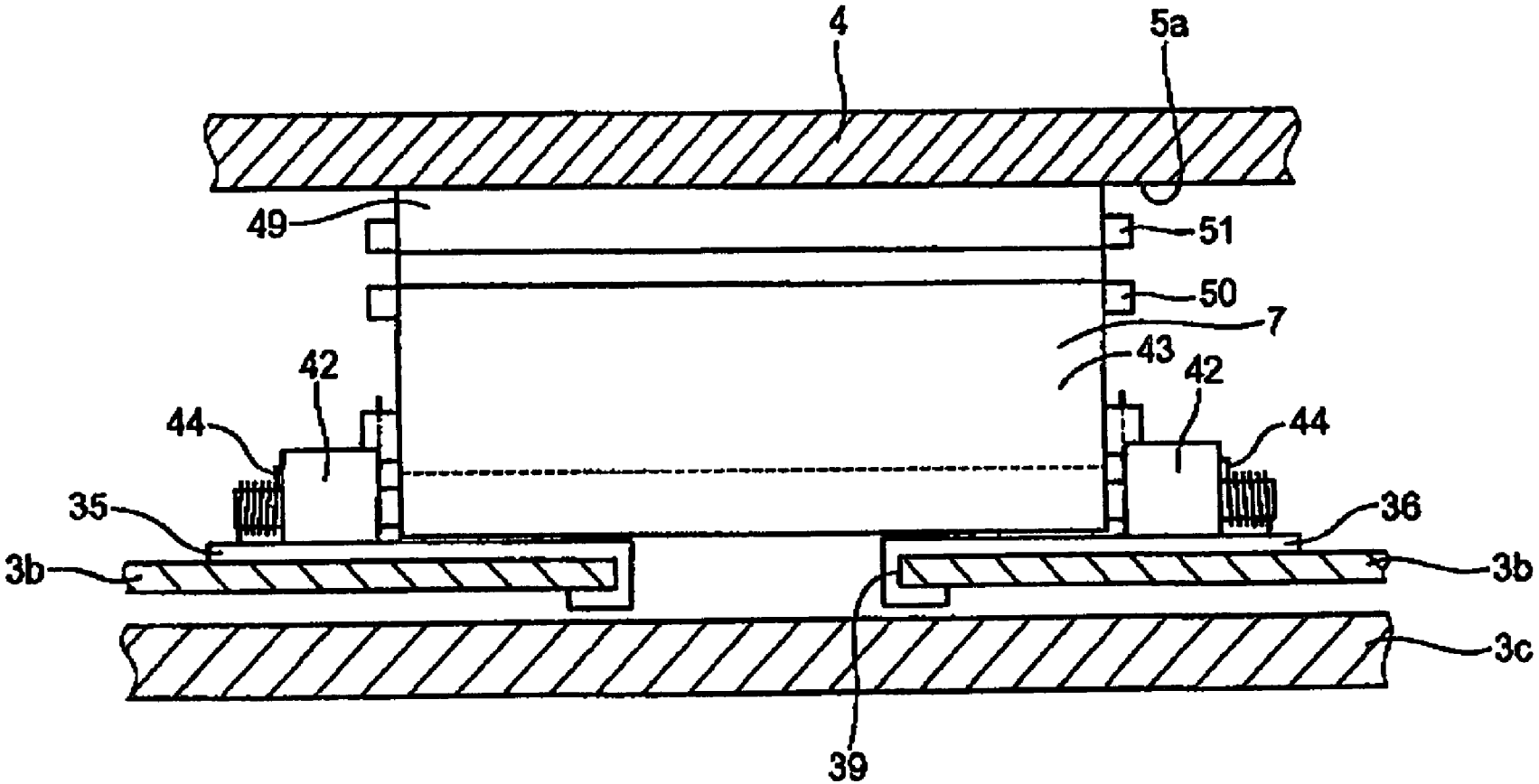
FIG. 20 is a view taken in the direction of arrow F in FIG. 19.

FIG. 17 is a front view illustrating the edge guide 7 in accordance with the present embodiment, and FIG. 18 shows the edge guide 7 in a view taken in the direction of arrow E in FIG. 17. FIG. 19 is a front view illustrating the edge guide 7, with the feeder tray 3 being retracted in the open recess 5 of the body 4, and FIG. 20 shows the edge guide 7 in a view taken in the direction of arrow F in FIG. 19.

As shown in FIG. 17, in the present embodiment, an inclined portion 47 is formed at the top end of the edge guide 7 so as to extend therefrom in the tilt direction thereof. A roller 48 is provided at the top end of the inclined portion 47. The roller 48 is to be brought into contact with the abutting surface 5*a* of the open recess 5 of the body 4, for functioning as a friction reduction mechanism.

As shown in FIG. 17, a shaft 50 is fixed at the top end of the inclined portion 47 in parallel to the shaft 41. The shaft 50 is inserted into the roller 48 for rotatable connection therebetween The roller 48 is preferably made up of synthetic resin or rubber. Additionally, a shaft 51 is fixed at the base end of the inclined portion 47 in the same manner as described above, and is inserted into a roller 49 for rotatable connection therebetween. The roller 49 is preferably made up of synthetic resin or rubber.

In the present embodiment, the friction reduction mechanism is in the form of roller 48 which may be coated with a synthetic resin having a slippery surface due to a better lubricity thereof, such as PTFE resin. The roller 49 may be removed, where appropriate.

Further, in the present embodiment, as shown in FIG. 17, there is employed, for always biasing the edge guide 7 toward the standing position, a biasing mechanism BM in the form of a wire-like spring. The detailed description thereof will be omitted, in view of the biasing mechanism BM being common in construction to that of the third embodiment, for avoiding a redundant description.

Next, the retraction of the feeder tray 3 into the open recess of the body 4 will be described.

As shown in FIGS. 17 and 18, once the feeder tray 3 attempts to be retracted into the open recess 5 with the edge guide 7 being in the standing position, the roller 48 disposed at the inclined portion 47 of the edge guide 7 is first brought into contact with the abutting surface 5*a* of the open recess 5. As a result, the roller 48, while being rotated smoothly, is pivoted in the aforementioned tilt direction indicated by the curved arrow in FIG. 9 toward the inclined position.

The edge guide 7 is so limited in an allowable pivotal-direction by the bottom wall 43 functioning as the aforementioned pivotal-direction limiter, as to inhibit the edge guide 7 from being pivoted away from the inclined position. Therefore, the edge guide 7 is rendered to be pivotable only in the tilt direction.

As a result, upon the feeder tray 3 being further advanced toward the retracted position within the open recess 5, the roller 49 disposed at the base end of the inclined portion 47 is then brought into contact with the abutting surface 5*a* of the open recess 5. Thereafter, the edge guide 7 is further tilted toward the inclined position, while the roller 49 is being rotated due to relative movement thereof with the abutting surface 5*a*.

Once the feeder tray 3 has been completely retracted into the open recess 5, the edge guide 7 is accommodated within the open recess 5 with the edge guide 7 being in the inclined position. At the moment, the depth of the open recess 5 required for accommodating the entire of the edge guide 7 becomes equal to the height of the bottom wall 43.

As will be readily understood from the above description, in the present embodiment, the roller 48 constitutes an example of the "translating mechanism" set forth in mode (17), and the rollers 48 and 49 each constitute an example of the "friction reduction mechanism" set forth in mode (19).

Then, with reference to FIGS. 21-23, a fourth embodiment of the present invention will be described.

In view of the fact that the present embodiment is common in basic construction to the first embodiment, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

Further, in view of the fact that the edge guides 7 and 8 are structurally common to each other in the present embodiment like in the first embodiment, only the edge guide 7 will be representatively illustrated and described.

Figure 21:
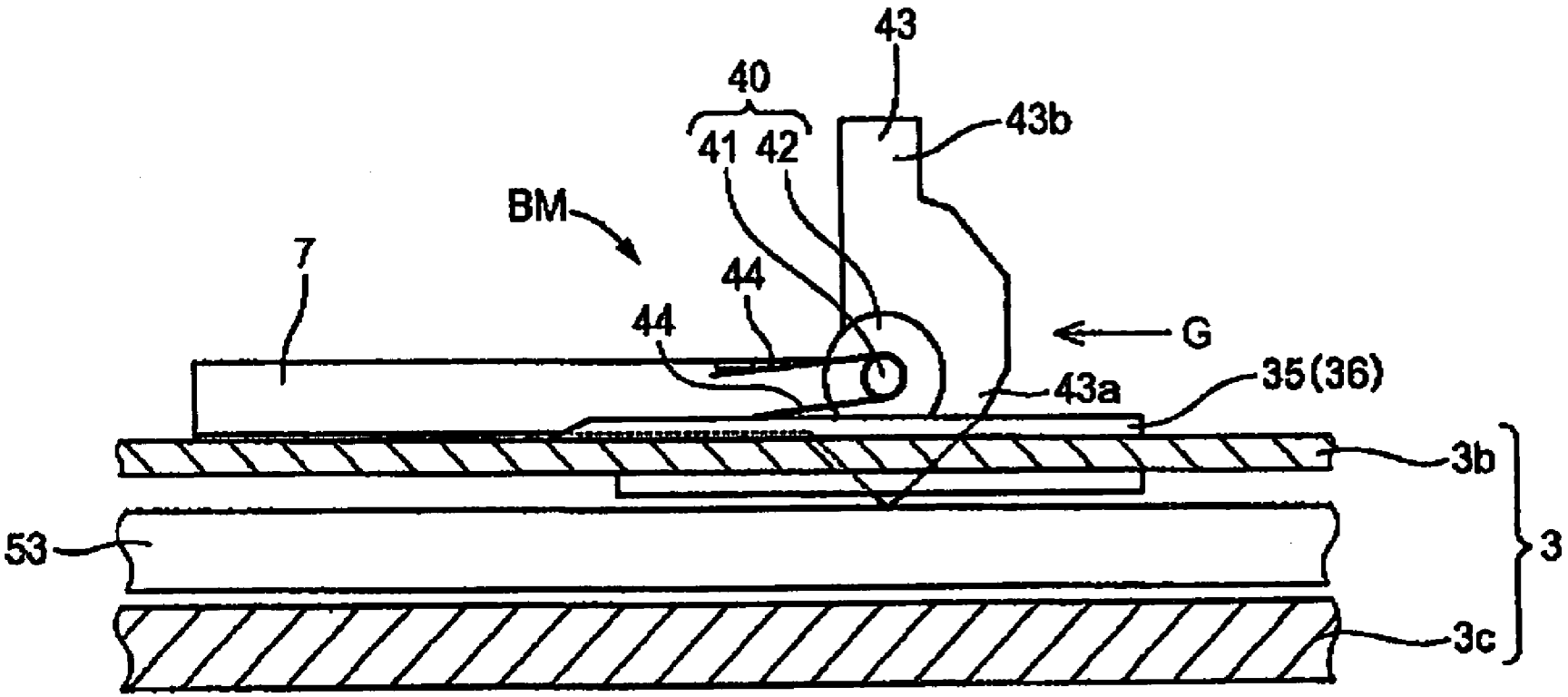
FIG. 21 is a front view illustrating a representative one of edge guides of a feeder tray of a sheet feeding unit, with the feeder tray being in a retracted position, the sheet feeding unit being constructed according to a fourth embodiment of the present invention.
Figure 22:
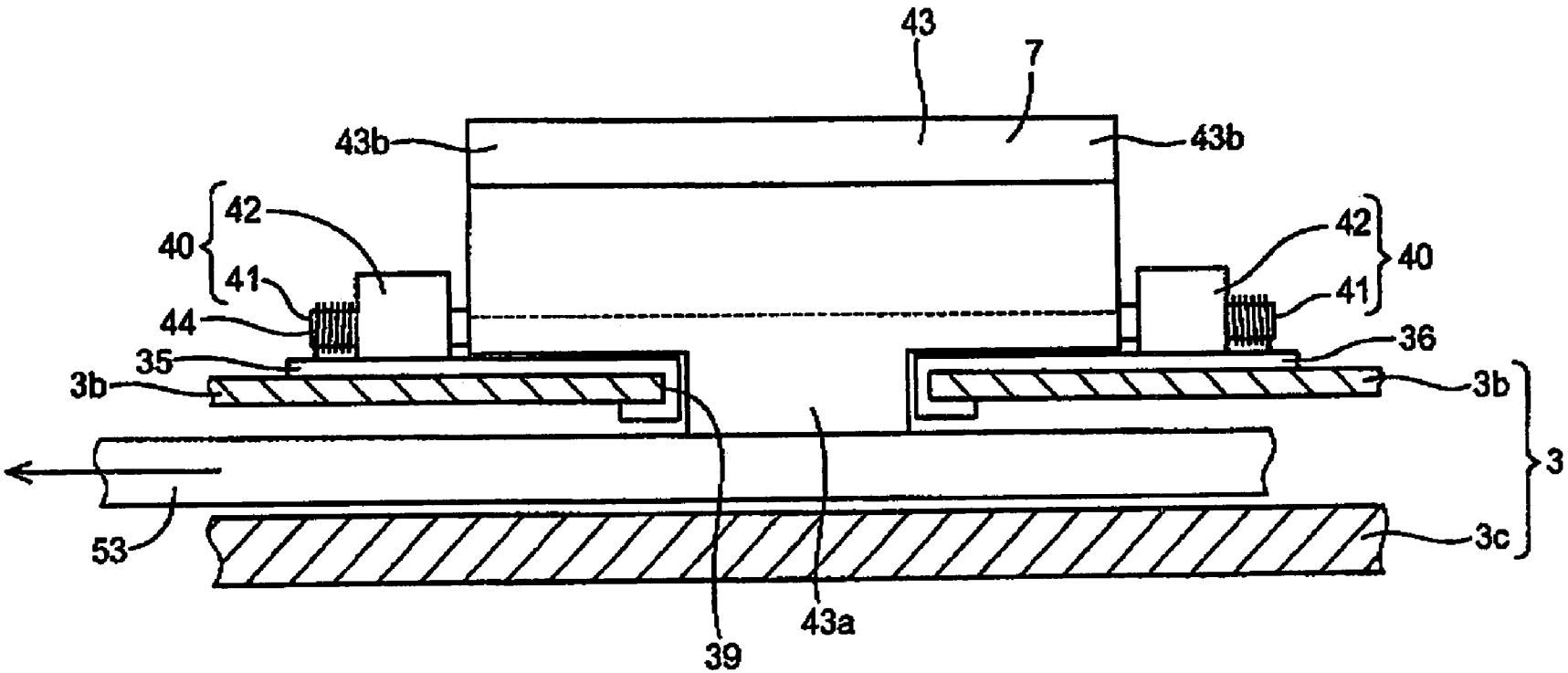
FIG. 22 is a view taken in the direction of arrow G in FIG. 21.

FIG. 21 is a front view illustrating the edge guide 7 in accordance with the present embodiment, with the feeder tray 3 being in the retracted position, and FIG. 22 shows the edge guide 7 in a view taken in the direction of arrow G in FIG. 21. FIG. 23 is a side view illustrating the edge guide 7.

As shown in FIG. 21, in the present embodiment, the feeder tray 3 is configured to incorporate a retractable auxiliary tray 53 so as to be slidable parallel to the feeding direction FD. The auxiliary tray 53 is generally in the form of a plate which is interposed between two opposing plate-like sections of the feeder tray 3, with the auxiliary tray 53 and the two sections being superposed on each other.

The auxiliary tray 53 is displaceable between a retracted position and an extended position. In the retracted position of the auxiliary tray 53, the feeder tray 3 is stored within the open recess 5 with the edge guide 7 being in-the inclined position, i.e., the retracted position.

An engaging projection 43*a* is formed at a selected portion of the base end of the bottom wall 43 functioning as the aforementioned pivotal-direction limiter. The engaging projection 43*a* is fitted into and passed through the elongated hole 39 formed in the feeder tray 3, as shown in FIG. 22. The engaging projection 43*a* projects from the edge guide 7 toward the auxiliary tray 53, with the edge guide 7 being in the inclined position, as shown in FIG. 21.

As shown in FIG. 21, where the auxiliary tray 53 is in the retracted position, the engaging projection 43*a* is engaged with an upper surface of the auxiliary tray 53, preventing the edge guide 7 from being pivoted from the inclined position to the standing position irrespective of the biasing force applied from the biasing mechanism BM.

Once the user has withdrawn the auxiliary tray 53 from the feeder tray 3, the engaging projection 43*a* is released from engagement with the auxiliary tray 53, permitting the edge guide 7 to be pivoted. As a result, the edge guide. 7 is pivoted to the standing position because of the biasing force applied from the biasing mechanism BM.

In the standing position of the edge guide 7, as shown in FIG. 22, both end portions 43*b* and 43*b* of the bottom wall 43, which are portions of the bottom wall 43 other than the engaging projection 43*a*, are engaged with the upper surface of the attachment base 35 or 36 or the upper surface of the feeder tray 3. The engagement prevents the edge guide 7 from being further pivoted away from the standing position.

Then, the retraction of the feeder tray 3 into the open recess 5 of the body 4 will be described.

Figure 23:
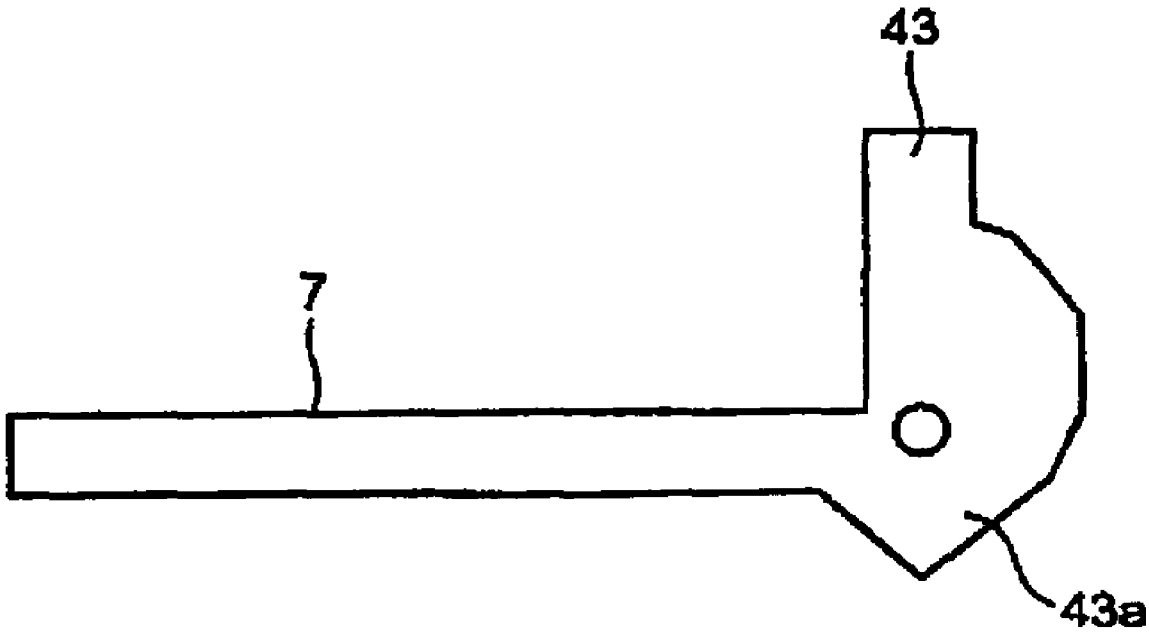
FIG. 23 is a front view illustrating the edge guide shown in 21.

As shown in FIGS. 21 and 23, upon manual tilt of the edge guide 7 up to the inclined position, the auxiliary tray 53 is retracted into and in turn stored within the feeder tray 3. In this state, the engaging projection 43*a* of the bottom wall 43 has been fitted into the elongated hole 39 and engaged with the upper surface of the auxiliary tray 53, inhibiting the edge guide 7 from being pivoted. As a result, the edge guide 7 is kept to be in the inclined position. The feeder tray 3 is then retracted into the open recess 5 with the feeder tray 3 being kept in state.

On the other hand, in the unfolded position of the feeder tray 3, once the user has withdrawn the auxiliary tray 53 from the feeder tray 3, the engagement between the upper surface of the auxiliary tray 53 and the engaging projection 43*a* is released, rendering the edge guide 7 and the engaging projection 43*a* being pivotable. As a result, the biasing mechanism BM raises up the edge guide 7 up to the standing position, and in turn the both end portions 43*b* and 43*b* are brought into engagement with the upper surface of the attachment base 35 or 36 or the upper surface of the feeder tray 3, preventing further pivot of the edge guide 7 from the standing position in the same direction.

As will be readily understood from the above description, in the present embodiment, the edge guides 7 and 8 each constitute an example of the "edge guide" set forth in mode (23) or (24), and the auxiliary tray 53 constitutes an example of the "auxiliary tray" set forth in mode (24).

Further, in the present embodiment, the biasing mechanism 3M constitutes an example of the "biasing mechanism" set forth in mode (25), the base end 7*b* of the edge guide 7 constitutes an example of the "base end" set forth in the same mode, and the elongated hole 39 constitutes an example of the "hole" set forth in the same mode.

It is added that the edge guides 7 and 8 may be replaced with edge guides for a separation feeding mechanism separating stacked sheets of paper, to thereby retrieve individual sheets of paper one by one. The edge guides are used for guiding the lateral edges of the separated and retrieved sheet of paper in the separation feeding mechanism, an example of which is embodied as the cassette 28 shown in FIG. 3.

Although the several embodiments of the present invention have been described individually above, it is of course possible to practice the present invention in any one of combinations of these embodiments within the scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An apparatus for feeding a sheet to a processing device processing the sheet, comprising:

a feeder tray displaceable to a selected one of a retracted position and an unfolded position relative to the processing device, as a result of a pivotal movement of the feeder tray relative to the processing device about a line perpendicular to a feeding direction of the sheet to be fed to the processing device, and having a sheet-loaded plane on which the sheet is to be loaded;

a pair of edge guides disposed at the sheet-loaded plane, having a pair of corresponding respective side walls co-extending along the feeding direction of the sheet in opposed relation with each other, to thereby guide lateral edges of the sheet;

a supporting device supporting each of the edge guides pivotably about a pivot axis parallel to the feeding direction, to thereby allow the each edge guide to be displaced between a standing position on the sheet-loaded plane and an inclined position inclined to the standing position; and a holding mechanism holding each of the edge guides in the standing position, with the feeder tray being in the unfolded position, wherein the holding mechanism elastically biases each of the edge guides toward the standing position, to thereby allow the each edge guide to return to the standing position in timed relation with displacement of the feeder tray from the retracted position to the unfolded position.

2. The apparatus according to claim 1, wherein the holding mechanism holds each of the edge guides in the standing position, using a friction applied to the each edge guide, with the feeder tray being in the unfolded position.

3. The apparatus according to claim 1, further comprising a tilting mechanism tilting each of the edge guides from the standing position to the inclined position through pivotal movement of the each edge guide in timed relation with displacement of the feeder tray from the unfolded position to the retracted position.

4. The apparatus according to claim 3, wherein the tilting mechanism tilts each of the edge guides from the standing position to the inclined position through the pivotal movement, using a reaction force applied from the processing device to the each edge guide upon abutting of the each edge guide against the processing device, in timed relation with displacement of the feeder tray from the unfolded position to the retracted position.

5. The apparatus according to claim 1, further comprising a moving body disposed at the feeder tray for connecting each of the edge guides to the feeder tray, the moving body being movable in a direction perpendicular to the feeding direction relative to the feeder tray, the each edge guide and the corresponding moving body being formed separately from and rotatably connected with each other at a position located above the sheet-loaded plane.

6. The apparatus according to claim 1, wherein the supporting device is located in the vicinity of the sheet-loaded plane.

7. The apparatus according to claim 5, wherein the supporting device includes: a shaft disposed at a selected one of each of the edge guides and the corresponding moving body, and extending parallel to the feeding direction; and a bearing device disposed at a remainder of the each edge guide and the corresponding moving body, and supporting the shaft rotatably.

8. The apparatus according to claim 7, wherein the bearing device includes a pair of bearings, the shaft includes a pair of ends projecting from both end faces of each of the edge guides opposed to each other in the feeding direction, the shaft is rotatably supported at the pair of projecting ends thereof by the pair of bearings.

9. The apparatus according to claim 1, further comprising a holder holding each of the edge guides in a selected one of the standing position and the inclined position, wherein each of the edge guides is positioned in the standing position with the feeder tray being in the unfolded position, while each of the edge guides is pivoted to the inclined position upon displacement of the feeder tray to the retracted position.

10. The apparatus according to claim 9, wherein the holder includes a pivotal-direction limiter limiting an allowed pivotal direction of each of the edge guides to a predetermined unilateral direction from the standing position.

11. The apparatus according to claim 10, wherein the pivotal-direction limiter is disposed at a corresponding one of the edge guides.

12. The apparatus according to claim 11, wherein the pivotal-direction limiter includes a bend to a corresponding one of the edge guides, disposed at a base end of the corresponding edge guide, and extending away from a corresponding one of the side walls.

13. The apparatus according to claim 1, wherein each of the edge guide is pivoted between the standing position and the inclined position in timed relation with motion of the feeder tray between the retracted position and the unfolded position.

14. The apparatus according to claim 13, wherein each of the edge guides is pivoted to the inclined position upon abutting of the each edge guide against the processing device during displacement of the feeder tray from the unfolded position to the retracted position.

15. The apparatus according to claim 14, further comprising a translating mechanism translating a reaction force applied to each of the edge guides from the processing device upon abutting of the each edge guide against the processing device, into a moment causing the each edge guide to pivot.

16. The apparatus according to claim 14, wherein the processing device includes an abutting surface which each of the edge guides abuts during displacement of the feeder tray from the unfolded position to the retracted position, the abutting surface having a profile allowing an application to the each edge guide a force causing the each edge guide to pivot, through abutting of the each edge guide against the abutting surface.

17. The apparatus according to claim 14, further comprising a friction reduction mechanism reducing a friction developed between each of the edge guides and the processing device, with the each edge guide and the processing device being in contact with each other.

18. The apparatus according to claim 1, further comprising a biasing mechanism biasing each of the edge guides toward the standing position.

19. The apparatus according to claim 18, wherein the biasing mechanism includes a spring member.

20. The apparatus according to claim 1, wherein each of the edge guides is pivoted between the standing position and the inclined position depending on a manual operation independent of a motion of the feeder tray between the retracted position and the unfolded position.

21. The apparatus according to claim 20, further comprising an auxiliary tray slidable parallel to the feeding direction relative to the feeder tray, and displaceable to a selected one of a retracted position and an extended position, each of the edge guides being pivoted from the inclined position to the standing position in timed relation with a manual sliding motion of the auxiliary tray from the retracted position to the extended position relative to the feeder tray.

22. The apparatus according to claim 21, further comprising a biasing mechanism biasing each of the edge guides toward the standing position, wherein each of the edge guides includes a base end at which an engaging projection is formed at a position away from the pivot axis, wherein the engaging projection is disposed to be engageable with the auxiliary tray in the retracted position through a hole formed at the sheet-loaded plane, and wherein the engaging projection is moved away from the auxiliary tray upon a sliding motion of the auxiliary tray from the retracted position to the extended position, to thereby allow each of the edge guides to pivot to the standing position by a biasing force provided by the biasing mechanism, while the engaging projection is brought into engagement with the auxiliary tray upon a sliding motion of the auxiliary tray of the extended position to the retracted position, to thereby hold the each edge guide in the inclined position.

23. The apparatus according to claim 1, wherein the edge guides are independent of each other in pivoting between the standing position and the inclined position.

24. The apparatus according to claim 1, further comprising a separation feeding mechanism separating sheets stacked on the sheet-loaded plane of the feeder tray, to thereby feed individual sheets one by one.

25. An apparatus for forming an image on the sheet fed from the apparatus for feeding a sheet set forth in claim 1.

26. An apparatus for forming an image using a removable process cartridge incorporating a developer developing an electrostatic latent image formed on a photoconductor, comprising the apparatus for feeding a sheet set forth in claim 1, wherein the feeder tray of the apparatus for feeding a sheet is displaceable in a direction allowing the process cartridge to be attached to and removed from the apparatus for forming an image.

27. An apparatus for feeding a sheet to a processing device processing the sheet, comprising:

a feeder tray displaceable to a selected one of a retracted position and an unfolded position relative to the processing device, and having a sheet-loaded plane on which the sheet to be fed to the processing device is to be loaded;

a pair of edge guides disposed at the sheet-loaded plane, having a pair of corresponding respective side walls co-extending along the feeding direction of the sheet in opposed relation with each other, to thereby guide lateral edges of the sheet;

a supporting device supporting each of the edge guides pivotably about a pivot axis parallel to the feeding direction, to thereby allow the each edge guide to be displaced to a selected one of a standing position on the sheet-loaded plane and an inclined position inclined to the standing position; and a roller attached rotatably to a portion of each of the each of the edge guides which is to be brought into contact with the processing device, wherein the roller allows each edge guide to be pivoted to the inclined position upon abutting of each edge guide against the processing device during displacement of the feeder tray from the unfolded position to the retracted position.

28. An apparatus for feeding a sheet to a processing device processing the sheet, comprising:

a feeder tray displaceable to a selected one of a retracted position and an unfolded position relative to the processing device, as a result of a pivotal movement of the feeder tray relative to the processing device about a line perpendicular to a feeding direction of the sheet to be fed to the processing device, and having a sheet-loaded plane on which the sheet to be fed to the processing device is to be loaded;

an auxiliary tray slidable parallel to a feeding direction of the sheet relative to the feeder tray and displaceable to a selected one of an extended and non-extended position;

a pair of edge guides disposed at the sheet-loaded plane, having a pair of corresponding respective side walls co-extending along the feeding direction of the sheet in opposed relation with each other, to thereby guide lateral edges of the sheet; and a supporting device supporting each of the edge guides pivotably about a pivot axis parallel to the feeding direction, to thereby allow the each edge guide to be displaced to a selected one of a standing position on the sheet-loaded plane and an inclined position inclined to the standing position, wherein each of the edge guides is pivoted between the standing position and the inclined position in timed relation with motion of the feeder tray between the retracted position and the unfolded position.

29. The apparatus according to claim 28, wherein each of the edge guides is pivoted to the inclined position upon abutting of the each edge guide against the processing device during displacement of the feeder tray from the unfolded position to the retracted position.

30. The apparatus according to claim 29, further comprising a friction reduction mechanism reducing a friction developed between each of the edge guides and the processing device, with the each edge guide and the processing device being in contact with each other.

31. The apparatus according to claim 30, wherein the friction reduction mechanism includes a roller attached rotatably to a portion of each of the each of the edge guides which is to be brought into contact with the processing device.

32. An apparatus for feeding a sheet to a processing device processing the sheet, comprising:

a feeder tray displaceable to a selected one of a retracted position and an unfolded position relative to the processing device, as a result of a pivotal movement of the feeder tray relative to the processing device about a line perpendicular to a feeding direction of the sheet to be fed to the processing device, and having a sheet-loaded plane on which the sheet is to be loaded;

a pair of edge guides disposed at the sheet-loaded plane, having a pair of corresponding respective side walls co-extending along the feeding direction of the sheet in opposed relation with each other, to thereby guide lateral edges of the sheet;

a supporting device supporting each of the edge guides pivotably about a pivot axis parallel to the feeding direction, to thereby allow the each edge guide to be displaced between a standing position on the sheet-loaded plane and an inclined position inclined to the standing position; and a tilting mechanism tilting each of the edge guides from the standing position to the inclined position through pivotal movement of the each edge guide in timed relation with displacement of the feeder tray from the unfolded position to the retracted position.

33. The apparatus according to claim 32, wherein the tilting mechanism tilts each of the edge guides from the standing position to the inclined position through the pivotal movement, using a reaction force applied from the processing device to the each edge guide upon abutting of the each edge guide against the processing device, in timed relation with displacement of the feeder tray from the unfolded position to the retracted position.

34. The apparatus according to claim 32, wherein the pair of edge guides, when placed in the standing position, are opposed to each other in a width-wise direction of the sheet, and the tilting mechanism, in response to displacement of the feeder tray from the unfolded position to the retracted position, operates to tilt the pair of edge guides from the standing position to the inclined position, in only a direction allowing the pair of edge guides to move toward each other.

* * * * *